US011072453B2

(12) United States Patent
Whitehurst

(10) Patent No.: US 11,072,453 B2
(45) Date of Patent: Jul. 27, 2021

(54) LATCHABLE PACKAGING

(71) Applicant: Duallok Limited, London (GB)

(72) Inventor: Dane Whitehurst, London (GB)

(73) Assignee: DUALLOK LIMITED, London (GB)

( * ) Notice: Subject to any disclaimer, the term of this patent is extended or adjusted under 35 U.S.C. 154(b) by 0 days.

(21) Appl. No.: 16/600,368

(22) Filed: Oct. 11, 2019

(65) Prior Publication Data

US 2020/0115095 A1 Apr. 16, 2020

(30) Foreign Application Priority Data

Oct. 12, 2018 (GB) ..... 1816684
Oct. 26, 2018 (GB) ..... 1817496

(51) Int. Cl.
*B65D 5/32* (2006.01)
*B65D 5/38* (2006.01)
*B65D 5/02* (2006.01)

(52) U.S. Cl.
CPC ..... *B65D 5/0254* (2013.01); *B65D 5/326* (2013.01); *B65D 5/38* (2013.01); *B65D 2215/02* (2013.01)

(58) Field of Classification Search
CPC .... B65D 5/18; B65D 5/38; B65D 5/329–328; B65D 5/728; B65D 59/04; B65D 2583/0468; B65D 81/1275; B65D 81/3858
USPC ..... 229/103.11, 125.125, 122, 220, 913, 229/120.01
See application file for complete search history.

(56) References Cited

U.S. PATENT DOCUMENTS 3,949,928 A * 4/1976 Perkins ..... B65D 5/22 229/185.1
4,682,974 A * 7/1987 Sun ..... B65D 5/38 493/100
8,517,250 B2 * 8/2013 Philips ..... B65D 5/38 229/125.125
9,926,125 B2 * 3/2018 Whitehurst ..... B65D 79/00
9,981,788 B2 * 5/2018 Skinner ..... B65D 50/046
2016/0001937 A1 * 1/2016 Skinner ..... B65D 5/38 206/1.5
2019/0375537 A1 * 12/2019 Nakovski ..... B65B 5/04

FOREIGN PATENT DOCUMENTS

EP 2119635 A2 * 11/2009 ..... B65D 5/38

* cited by examiner

*Primary Examiner* — Nathan J Newhouse
*Assistant Examiner* — Philip D Schmidt
(74) *Attorney, Agent, or Firm* — Stoel Rives LLP

(57) ABSTRACT

A package including a support for supporting items, a primary structure for selectively blocking access to the items, and a secondary structure for covering at least some of the primary structure. The support is movable from a first position, whereat the primary structure blocks access to the items, to a second position, whereat the items are accessible. The support and primary structures comprise latch features designed to engage when the support and primary structures are in the first position to prevent movement of the support in the opening direction, and to disengage on moving at least one latch feature in an unlatching direction to accommodate movement of the support from the first position. The secondary structure comprises a disengagement region that cooperates with the latch features when the support and primary structure are in the first position to disengage the latch features.

20 Claims, 24 Drawing Sheets

LATCHABLE PACKAGING

RELATED APPLICATION DATA

This application is a nonprovisional of and claims the benefit under 35 U.S.C. § 119(a) of GB1816684.3, filed Oct. 12, 2018, and GB1817496.1, filed Oct. 26, 2018, each of which is entitled IMPROVEMENTS IN LATCHABLE PACKAGING, the disclosures of which are each incorporated by reference herein in their entireties.

TECHNICAL FIELD

The field of this disclosure relates generally to package design, and in particular, to child-resistant packaging having improved latching features to reduce the risk of children ingesting or using potentially hazardous materials.

BACKGROUND

Hazardous materials such as pharmaceutical products or controlled substances are typically stored in child-resistant closures or packages. Often it is a requirement by state legislation that hazardous products are safely stored in this way, and child-resistant requirements must be strictly adhered to, particularly at the point of sale.

As markets for controlled substances such as legalized cannabis grow, there is an increasing need for packaging that is child resistant, but that also allows companies flexibility of the design and aesthetic look of a package, for effective branding and marketing.

A latchable package is described in WO2017/129996. The latchable package comprises a support for supporting one or more items, a structure for selectively blocking access to the one or more items, and a substantially planar tab member coupled to the support such that the planar tab member moves with the support. The planar tab member and the structure comprise mutually co-operable latch formations that are engageable to prevent movement of the support and tab member relative to the structure.

Such packages provide effective child-resistant packages, with flexibility of aesthetic and branding at the point of manufacture.

However, it is always of benefit to increase the child resistance of a package where possible.

Furthermore, it is also beneficial to maximise flexibility of the properties and design of a child resistant package throughout the supply chain, without compromising the child-resistant functionality. In particular, different retailers may require different materials, different surface effects, different colours or different printed images on the package. The same retailer may also require different properties depending on demand or fashion.

It is against this background that the disclosed subject matter has been devised.

SUMMARY

Against this background, the disclosed subject matter resides in a latchable package comprising a support for supporting one or more items, a primary structure for selectively blocking access to the one or more items, and a secondary structure arranged or arrangeable to cover at least a part of the primary structure. The support is movable in an opening direction from a first position in which the primary structure blocks access to the one or more items to a second position in which the one or more items are accessibly clear of the primary structure. The support and the primary structure comprise co-operating latch features configured to engage when the support and the primary structure are arranged in the first position to prevent movement of the support in the opening direction, and configured to disengage on moving at least one latch feature in an unlatching direction to permit movement of the support in the opening direction. The secondary structure comprises a disengagement region that is arranged or arrangeable to at least partially align with the latch features when the support and the primary structure are arranged in the first position, and that is configured to permit disengagement of the latch features of the support and the primary structure when the disengagement region is at least partially aligned with the latch features.

The latch feature of the support may comprise a latch member. The latch feature of the primary structure may comprise a primary aperture. In this case, the latch feature of the support may protrude through the primary aperture when the support and the primary structure are arranged in the first position.

The disengagement region may be configured to permit disengagement of the latch features of the support and the primary structure through or via the disengagement region.

The disengagement region may comprise a secondary aperture. In this case, the latch feature of the support may protrude through the secondary aperture when the support and the primary structure are arranged in the first position and the disengagement region of the secondary structure may be aligned with the latch formations of the support and the primary structure.

The disengagement region may comprise a wall region that substantially overlies the latch features when the support and the primary structure are arranged in the first position. The wall region may be configured to be movable in the unlatching direction.

The wall region may be arranged to bear upon the latch feature upon movement of the wall region in an unlatching direction, to cause movement of the at least one latch feature in the unlatching direction.

At least a portion of the wall region that overlies the at least one latch feature may be flexible. A portion of the wall region adjacent to the at least one latch feature may be flexible.

The disengagement region may be located substantially mid-way along the secondary structure in the opening direction.

The thickness of the wall region may be less than the thickness of at least a portion of the secondary structure surrounding the wall region.

The secondary structure may have a thickness of between 0.1 mm and 2 mm.

The secondary structure may comprise an open end arranged to allow movement of the support in the opening direction.

A front end of the secondary structure may be substantially aligned with a front end of the primary structure when the support and the primary structure may be arranged in the first position. A rear end of secondary structure may be substantially aligned with a rear end of the primary structure when the support and the primary structure may be arranged in the first position. In other embodiments, the secondary structure and the primary structure may be of different lengths such that the front and rear ends do not align.

The secondary structure may have self-supporting rigidity.

The primary and/or secondary structure may comprise a sleeve.

The support may comprise a first stop feature configured to limit further movement of the support in the opening direction from the second position, and or a second stop feature to limit movement of the support in a direction opposite the opening direction from the first position.

The secondary structure may be coupled to the primary structure. For example, the secondary structure may be adhered to the primary structure, optionally at an adherence point. In this case, the adherence point may be positioned at an end of the package, preferably at a rear end of the package.

In other embodiments, the secondary structure may be coupled to the primary structure by a coupling flap. In this case, the coupling flap may be positioned at an end of the package, preferably at a front end of the package. The coupling flap may be joined to the secondary structure by a fold. Optionally, the coupling flap may be sandwiched between the primary structure and the support.

The dimensions of the secondary structure may be substantially the same as the dimensions of the primary structure.

The secondary structure may surround the primary structure in a close fit to provide a frictional engagement between the primary structure and the secondary structure.

An interior surface of the secondary structure may have a high surface roughness to inhibit relative movement between the primary structure and the secondary structure.

An exterior surface of the primary structure may have a high surface roughness to inhibit relative movement between the primary structure and the secondary structure. A coefficient of friction between the primary structure and the secondary structure may be higher than a coefficient of friction between the primary structure and the support.

The secondary structure may comprise opposing upper and lower walls, and the upper wall and lower walls may be of different lengths.

The support may comprise a substantially planar tab member. The substantially planar tab member may comprise the latch feature of the support.

The secondary structure may be formed of the same material as the primary structure. The secondary structure may be formed of a different material to the primary structure. The secondary structure may have a different surface finish to that of the primary structure.

The secondary structure may comprise a closure flap that may be selectively arrangeable to at least partially cover an end of the latchable package when the support and the primary structure are arranged in the first position, to selectively prevent movement of the support in the opening direction.

An end of the closure flap may be adhered to the primary structure or the secondary structure.

The closure flap may comprise a removable portion arranged such that removal of the removable portion opens the end of the latchable package or allows the closure flap to be opened.

The closure flap may include a tamper seal, which may be defined by a removable portion.

A rear end of the secondary structure may comprise a secondary access opening that permits access to a rear end of the support when the support and the primary structure are arranged in the first position.

A rear end of the primary structure may comprise a primary access opening that permits access to a rear end of the support when the support and the primary structure are arranged in the first position.

The latchable package may comprise a further support for supporting one or more items.

In this case, the latchable package may comprise a further primary structure for selectively blocking access to the one or more items in the further support, and the secondary structure may be arranged or arrangeable to cover at least a part of the further primary structure.

The further primary structure and the further support may comprise further co-operating latch features, and the secondary structure may comprise a further disengagement region that may be arranged or arrangeable to at least partially align with the further latch features when the further support and the further primary structure may be arranged in the first position, and that may be configured to permit disengagement of the further latch features of the further support and the further primary structure when the further disengagement region may be at least partially aligned with the further latch features.

The support and the further support may be incorporated into the package in a stacked arrangement.

The disclosed concept also extends to a method of assembling a package, the method comprising:

providing a primary package, the primary package comprising a support for supporting one or more items and a primary structure for selectively blocking access to the one or more items, wherein the support is movable in an opening direction from a first position in which the primary structure blocks access to the one or more items to a second position in which the one or more items are accessibly clear of the primary structure, and wherein the support and primary structure comprise co-operating latch features configured to engage when the support and primary structure are arranged in the first position to prevent movement of the support in the opening direction, and configured to disengage on moving at least one latch feature in an unlatching direction to permit movement of the support in the opening direction;

providing a secondary structure comprising a disengagement region; and arranging the primary package in the secondary structure, such that the disengagement region of the secondary structure at least partially aligns with the latch features of the primary package.

The method may comprise coupling the primary structure to the secondary structure, for example by adhering the primary structure to the secondary structure.

The method may comprise sliding the primary package into the secondary structure and/or sliding the secondary structure over the primary package.

The method may comprise wrapping the secondary structure around the primary package.

The method may comprise comprising arranging the primary structure and the support in the secondary structure simultaneously. Alternatively, the primary structure and the support may be arranged in the secondary structure successively: for example, the primary structure may be arranged in the support first, and the secondary structure may subsequently be arranged inside both the primary and secondary structures.

The disclosed subject matter further extends to a secondary structure for use in the package above, the secondary structure comprising a sleeve having an access opening for insertion of a primary package into the sleeve, and a disengagement region that is arrangeable to at least partially align with latch features on the primary package, the disengagement region being configured to permit disengagement of the latch features of the primary package when the disengagement region is at least partially aligned with the latch features.

Embodiments of the disclosed subject matter will now be described, by way of example only, with reference to the accompanying Figures.

DETAILED DESCRIPTION OF EXAMPLE EMBODIMENTS

Figure 1:
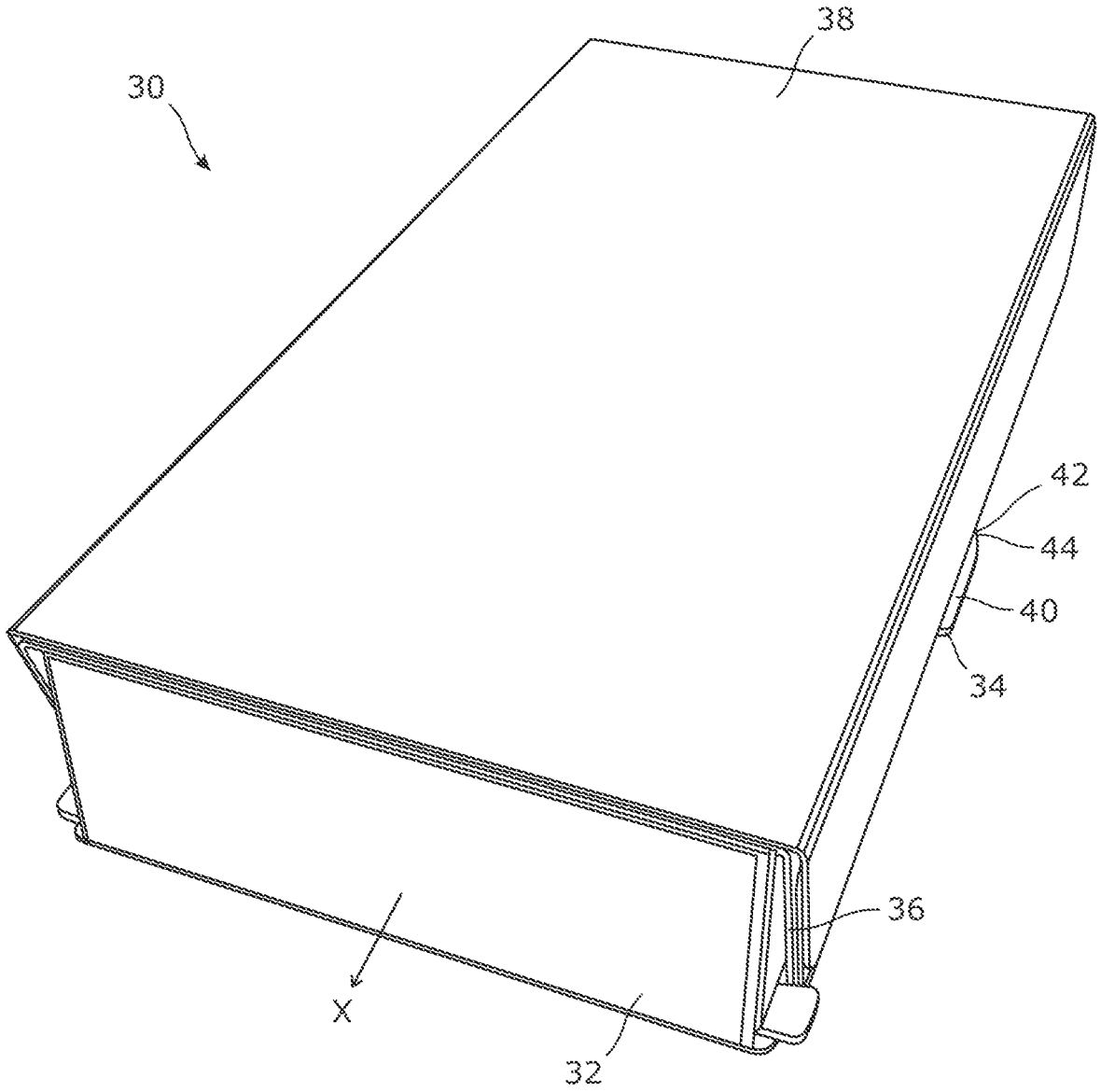
FIG. 1 is a perspective view of an enhanced package according to an embodiment in a fully-closed configuration.
Figure 2:
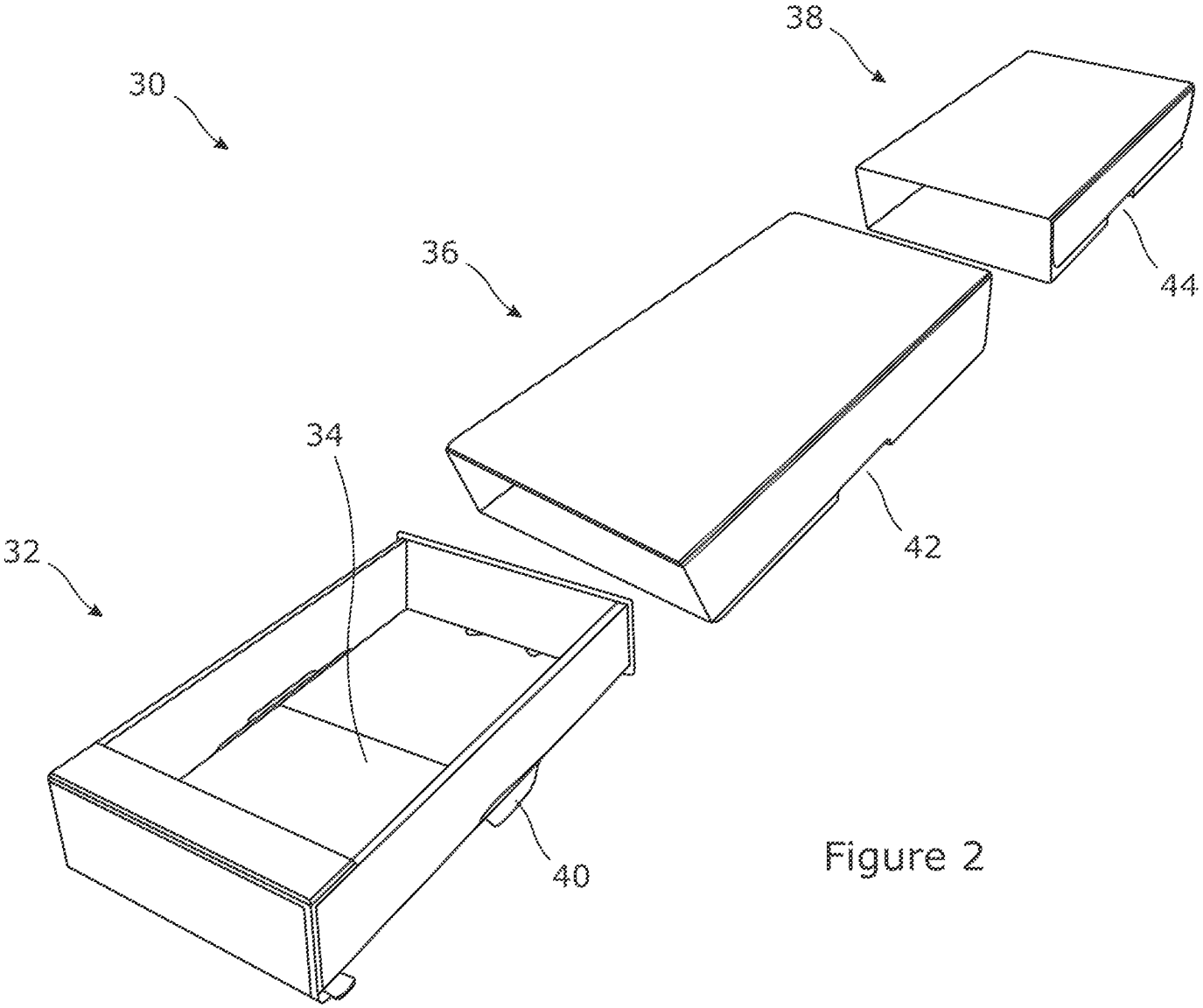
FIG. 2 is a perspective view of a support, a primary structure and a secondary structure of the enhanced package of FIG. 1.
Figure 3:
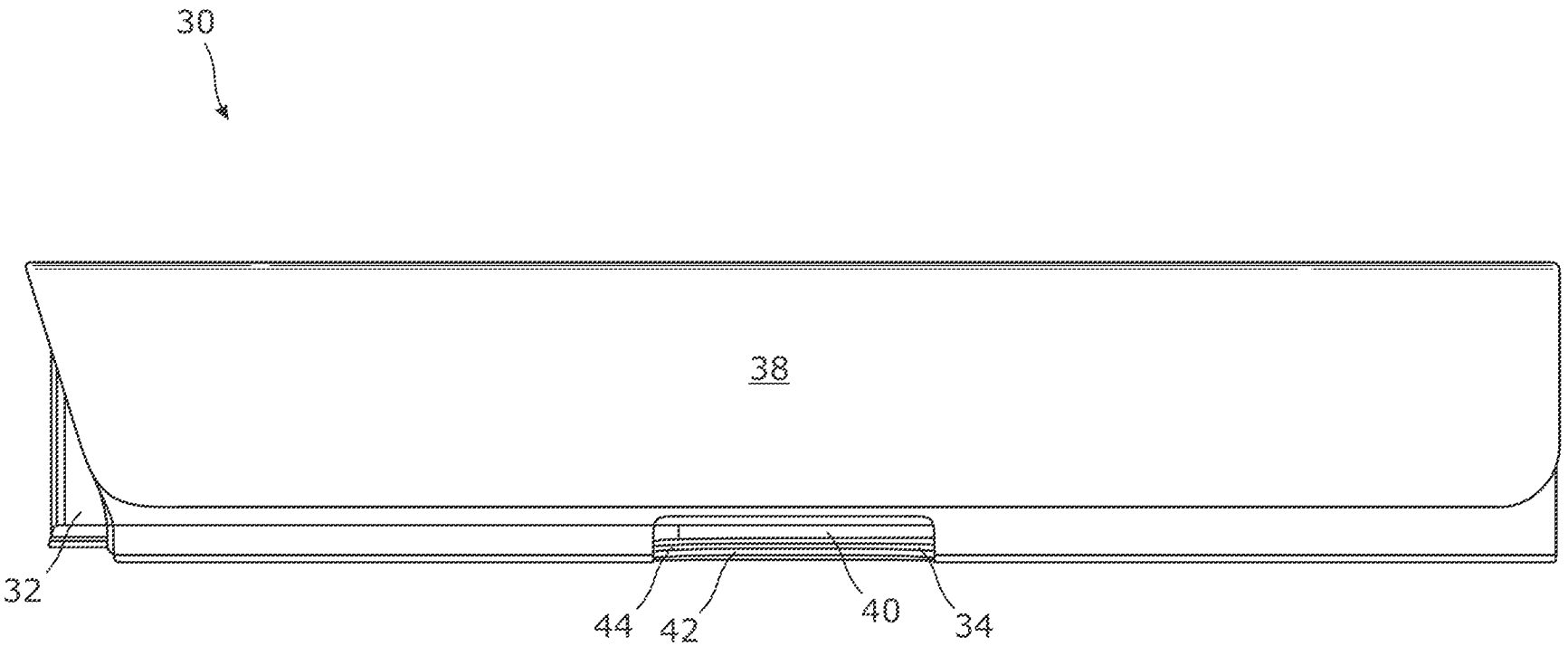
FIG. 3 is a side view of the enhanced package of FIG. 1.
Figure 4:
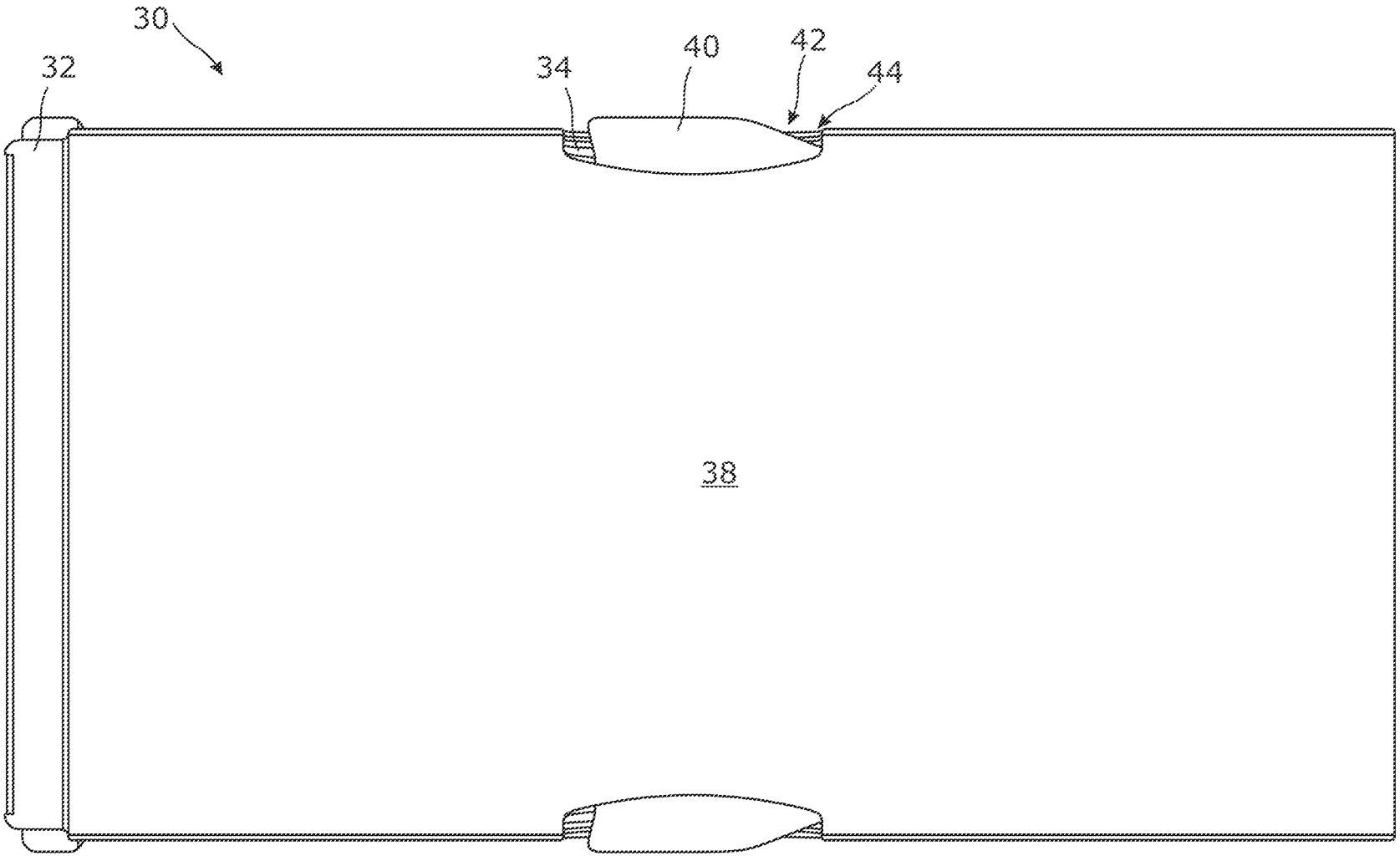
FIG. 4 is a plan view of the enhanced package of FIG. 1.

With reference to the drawings, this section describes particular embodiments of systems and methods relating to an improved latchable packaging design. Throughout the specification, reference to "one embodiment," "an embodiment," or "some embodiments" means that a particular described feature, structure, or characteristic may be included in at least one embodiment of the described system. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

FIGS. 1 to 4 illustrate an enhanced package 30 comprising a support 32 for supporting items, the support comprising planar tab member 34 coupled to a tray, a primary structure 36 in the form of a primary sleeve, and a secondary structure 38 in the form of a secondary sleeve.

Figure 5:
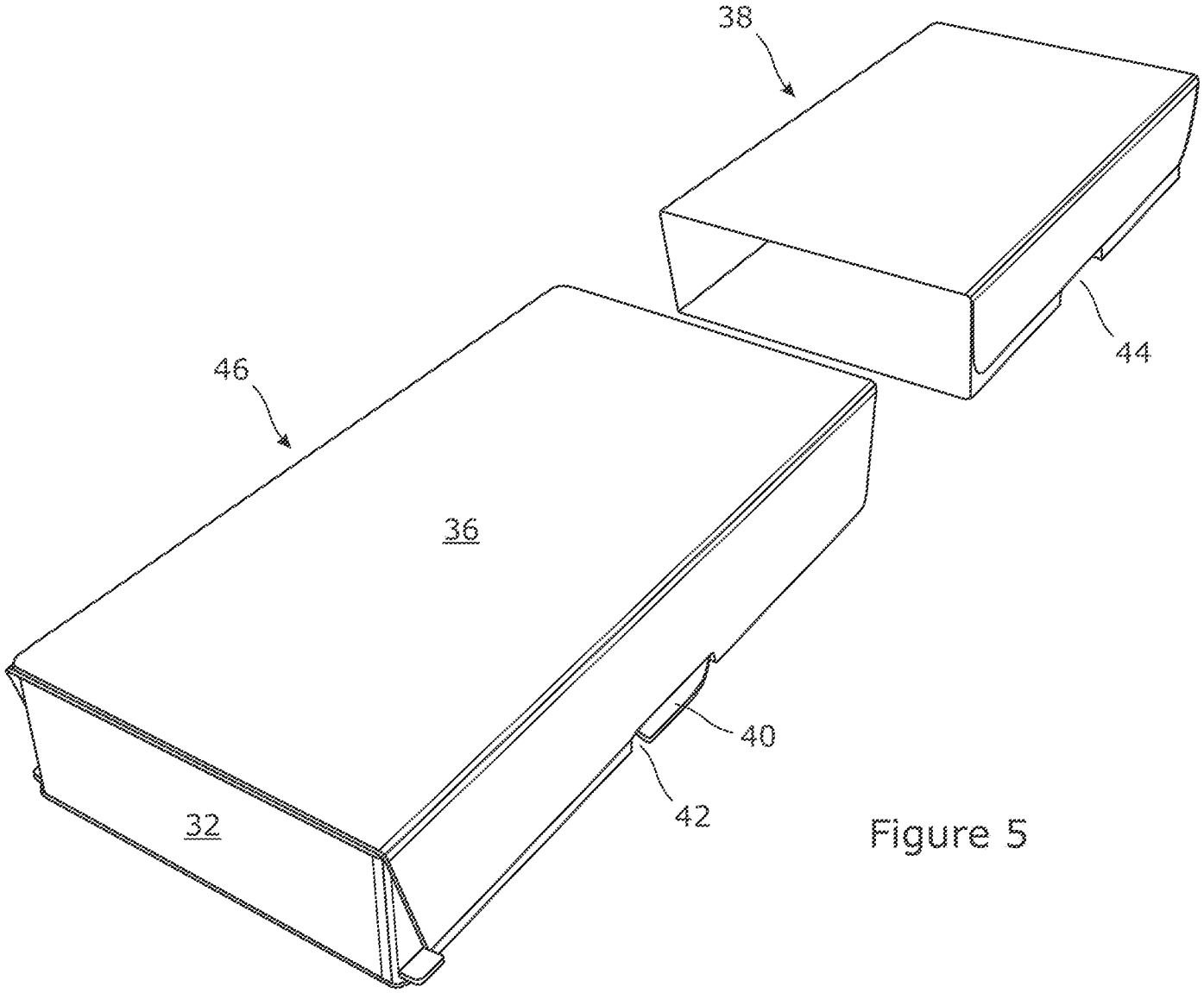
FIG. 5 is a perspective view of the enhanced package of FIG. 1, showing the support and the primary structure arranged to form a primary package, and the secondary structure removed from the primary package.
Figure 6:
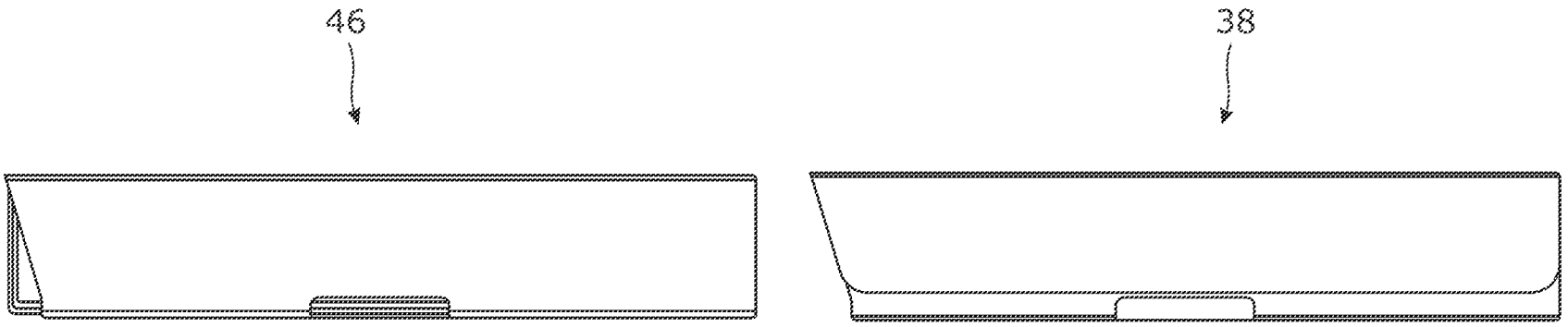
FIG. 6 is a side view of the primary package and secondary structure of FIG. 5.
Figure 7:
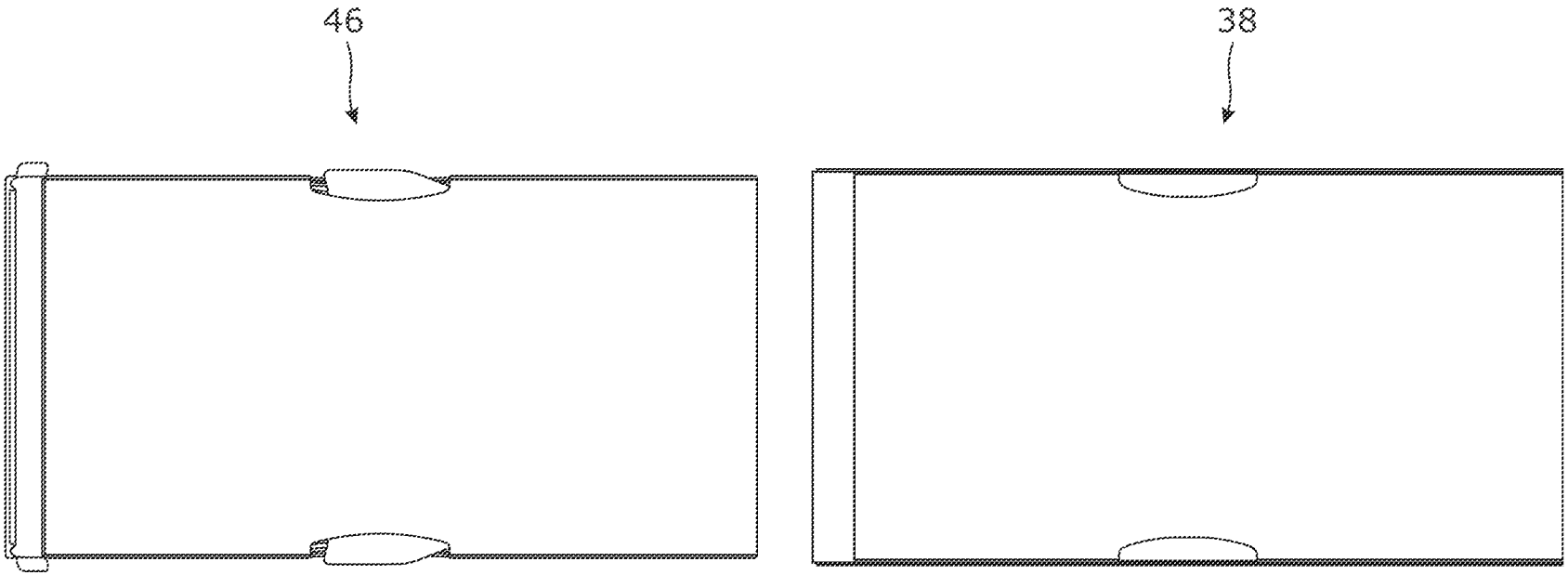
FIG. 7 is a plan view of the primary package and secondary structure of FIG. 6.

The support 32 (including the tab member 34) and the primary structure 36 together define a primary package 46, shown separately from the secondary structure 38 in FIGS. 5 to 7. The primary package 46 is combined with the secondary structure 38 to form the enhanced package 30.

In the primary package, the planar tab member (and hence the support) and the primary structure comprise mutually co-operable latch formations 40, 42 that are engageable to prevent movement of the support 32 and tab member 34 relative to the primary structure 36.

Referring back to FIGS. 1 to 4, in the enhanced package, the secondary structure 38 is arranged to cover at least a part of the primary structure 36. The secondary structure 38 comprises a disengagement region 44 that aligns with the latch formations 40, 42 of the support 32 and the primary structure 36. The disengagement region 44 is configured to allow disengagement of the latch formations 40, 42 of the support 32 and the primary structure 36, for example through or via the secondary structure 38.

In the embodiment shown, the disengagement region takes the form of a latch formation defined by an aperture 44 that is engageable with the latch formation 40 on the planar tab member 34. In this way, the disengagement region additionally prevents movement of the support 32 and tab member 34 relative to the secondary structure 38.

The primary package 46 is substantially the same as the package of WO2017/129996 as illustrated in FIGS. 1 to 14 and 15A to 15D and as described at Page 15 line 14 to Page 29 Line 4 of WO2017/129996 as published, these figures and portion of the description hereby being incorporated by reference into the present application.

Figure 8:
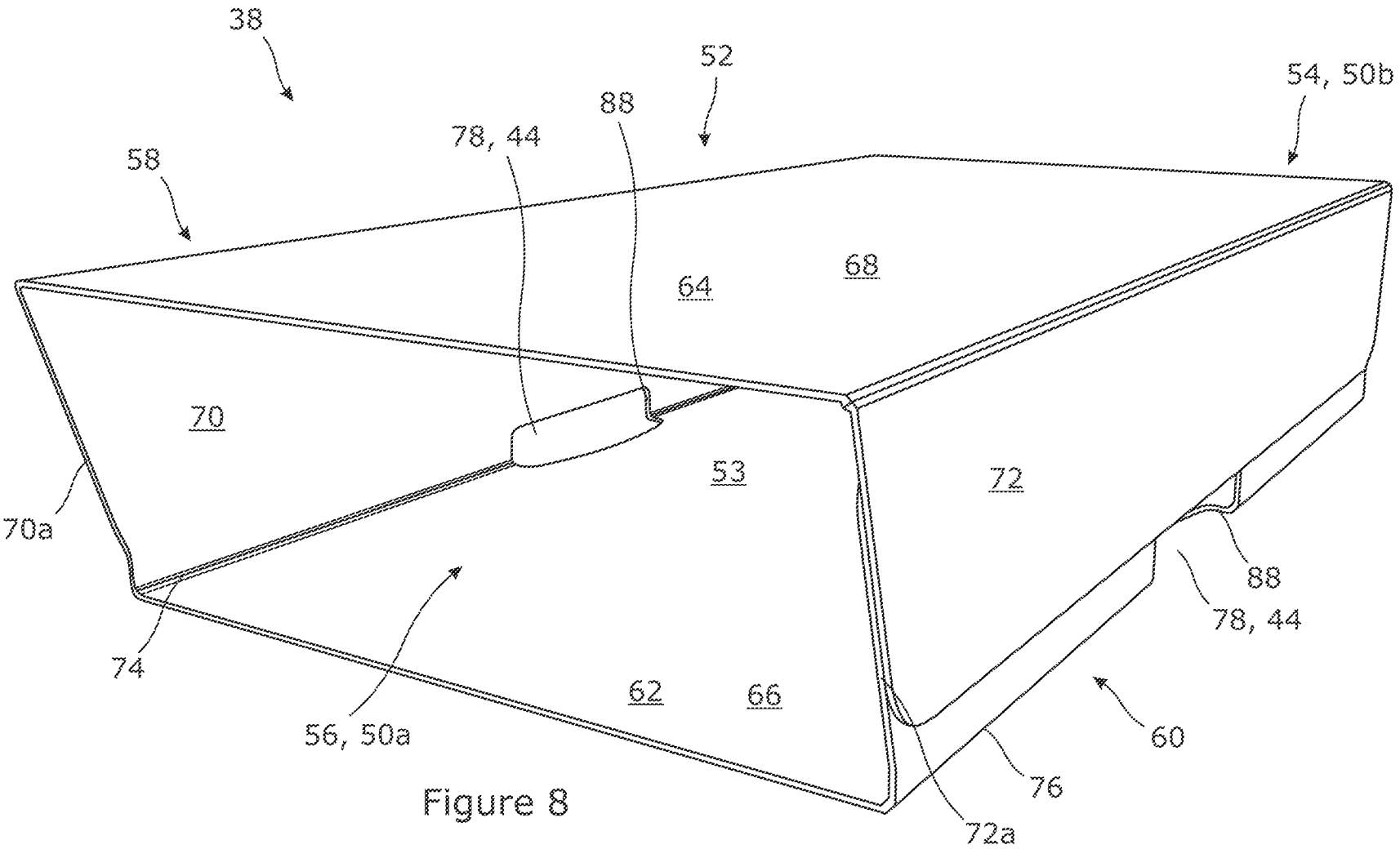
FIG. 8 is a perspective view of the secondary structure of the enhanced package of FIG. 1.
Figure 9:
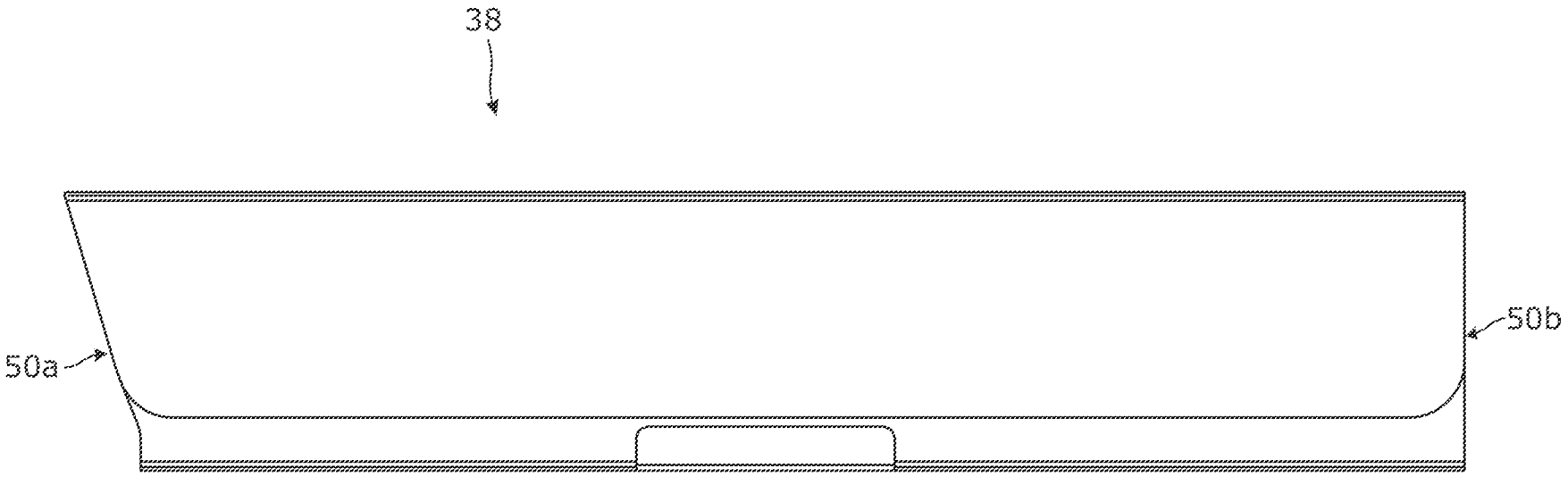
FIG. 9 is a side view of the secondary structure of the enhanced package of FIG. 1.
Figure 10:
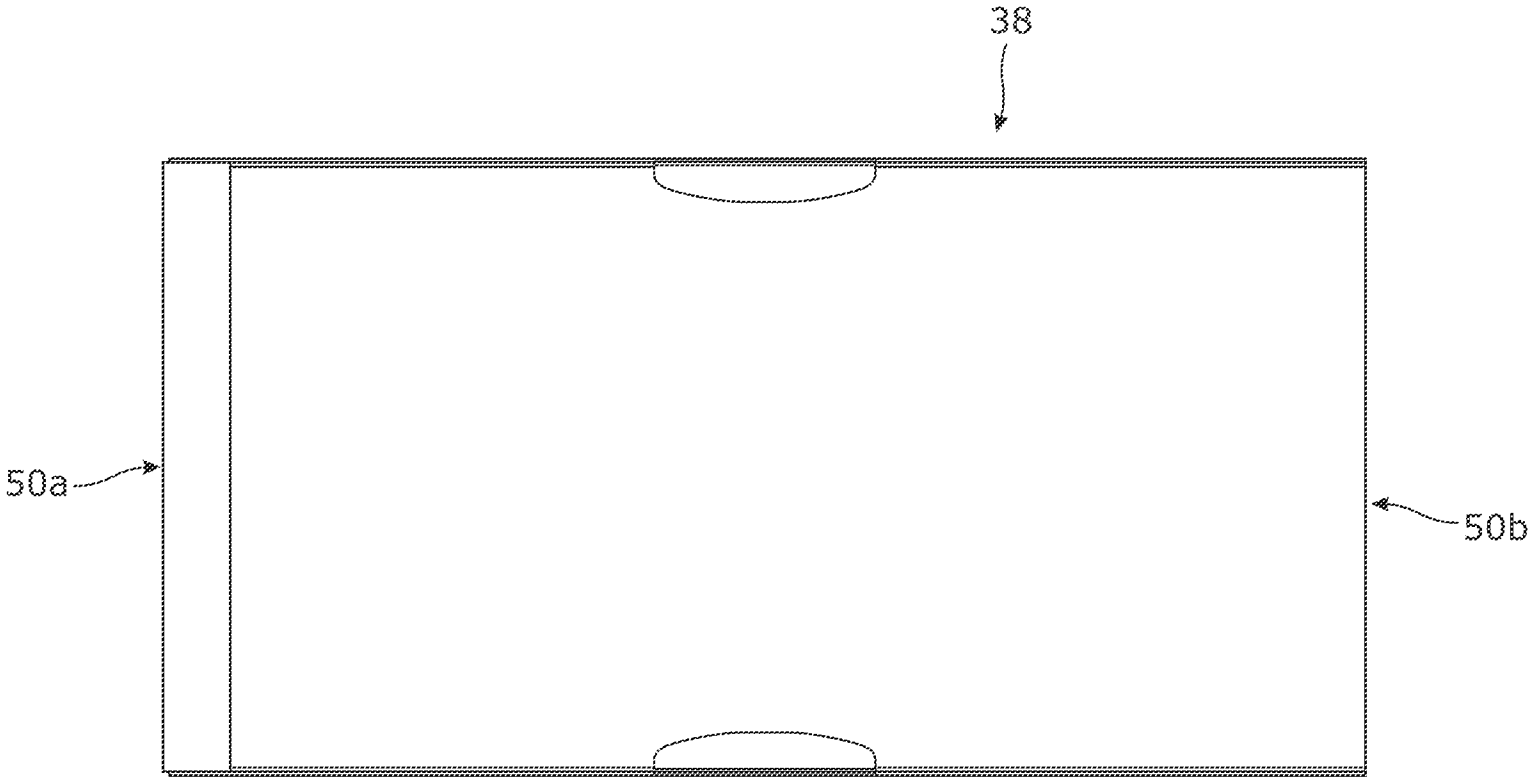
FIG. 10 is a plan view of the secondary structure of the enhanced package of FIG. 1.

The secondary structure 38 is shown in isolation in FIGS. 8 to 10. The secondary structure comprises a secondary sleeve 50 having open ends 50*a*, 50*b*. The secondary sleeve may be made of any suitable material, such as for example a thin card, paper or plastics material. In some embodiments the secondary sleeve is of self-supporting rigidity, though this need not always be the case. The sleeve may for example be a thin flexible sheet that is wrapped around the primary package by shrink wrapping or another suitable wrapping method.

Referring now to FIG. 8, the secondary sleeve 50 comprises a main body 52 in the form of a shell that defines an interior space 53. The secondary sleeve 50 has a rear end 54, a front end 56, a left side 58, a right side 60, a base 62 and a top 64.

The base 62 and top 64 of the secondary sleeve 50 are defined respectively by a generally planar base wall 66 and a generally planar upper wall 68. Left and right side walls 70, 72 join the base wall 66 to the upper wall 68 at respective left and right sides 58, 60 of the secondary sleeve 50.

The front end 56 of the secondary sleeve 50 is open to define the first open end 50*a*. At the front end the base wall 66 is a little shorter than the upper wall 68. In this way the front edges 70*a*, 72*a* of the left and right side walls 70, 72 taper rearwardly as they extend downwardly from the upper wall 68 to the base wall 66. In the assembled package 30, this slightly reduced length of the base wall 66 accommodates forward stop formations 35 (not visible in FIG. 8, but visible in FIG. 12) on the tab member 34.

At the left and right sides 58, 60 of the secondary sleeve, the base wall 66 comprises left and right side edges 74, 76 defined where the base wall 66 meets the left and right side walls 70, 72. Each side 58, 60 of the secondary sleeve 50 is provided with an elongate aperture 78 that straddles the respective left or right side edge 74, 76 to define the latch features 44 of the secondary structure 38. In this way, each elongate aperture 78 extends a short distance up the side wall 70, 72 and extends a short distance into the base wall 66.

An edge surface 80 surrounding the aperture 78 comprises a front edge that defines an abutment surface or abutment edge 82 on the secondary sleeve 50. In use, the latch formation 40 on the tab member 34 abuts against the abutment edge 82 to engage with the latch formation 40, thereby preventing movement of the tab member 34 and hence the support 32.

Each aperture 78 is disposed centrally between the front and rear ends 58, 60 of the secondary sleeve 50. In particular, each aperture 78 is positioned at the same location along the sleeve 50 as the apertures 42 of the primary structure 36. In this way, in the assembled package 30, the apertures 42, 44 of the primary and secondary structures align with each other, and with the latches of the tab member 34.

The apertures 78 are of a length that is slightly greater than the length of a latch formation 40 of the tab member 34. In this way, in the assembled package 30, the latch formation 40 can be received in the aperture 78.

Figure 11:
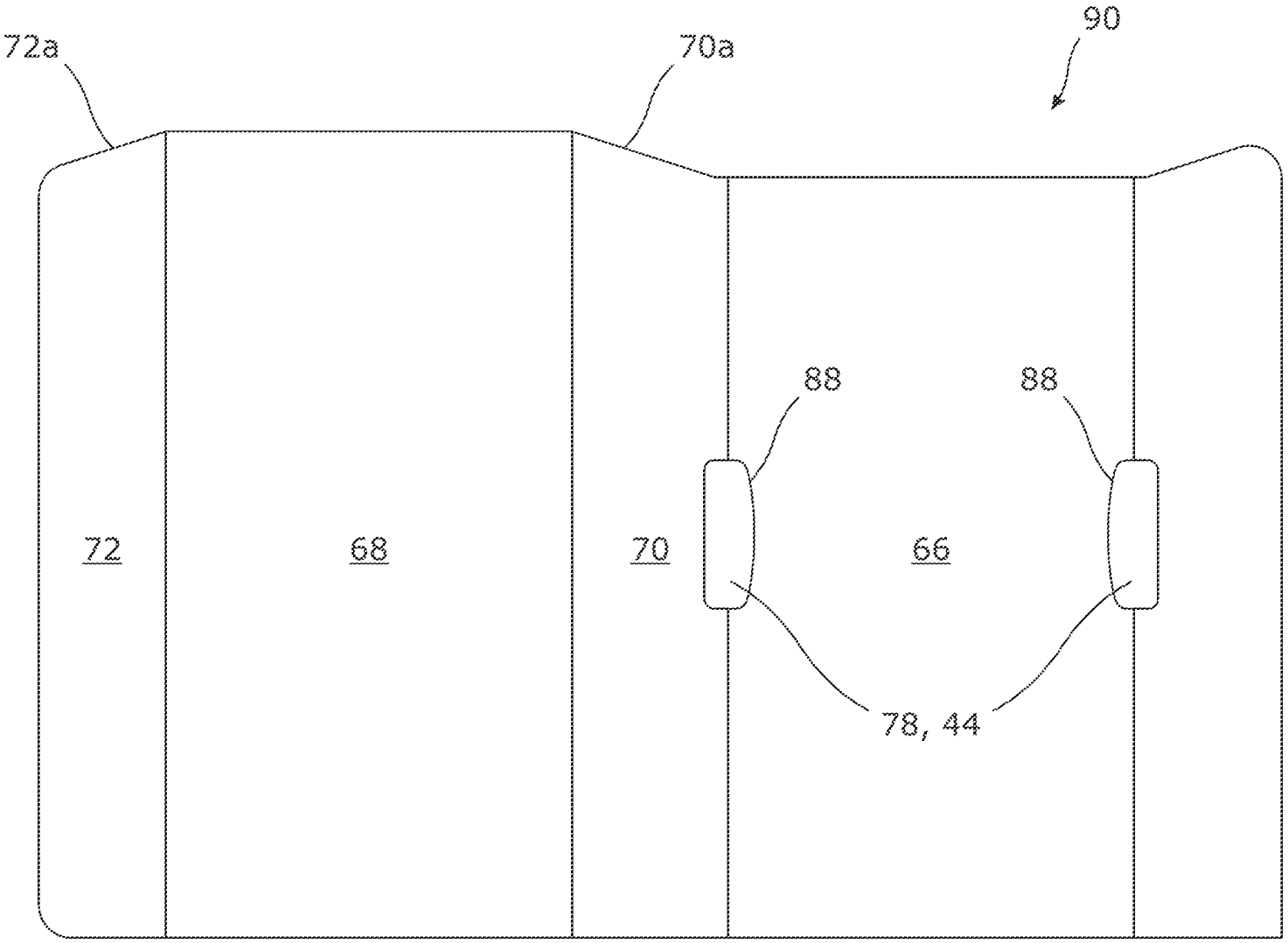
FIG. 11 shows a blank that can be folded to form the primary structure of the enhanced package of FIG. 1.

In the embodiment shown, the primary sleeve 50 is made of cardboard, and is formed by folding a flat blank 90 shown in FIG. 11 into the configuration shown in FIGS. 7 to 10. However, the primary sleeve 50 may be formed from any suitable material and by any suitable method. For example, the primary sleeve 50 may be formed from a plastics material such as impact styrene by vacuum forming or injection moulding.

Figure 12:
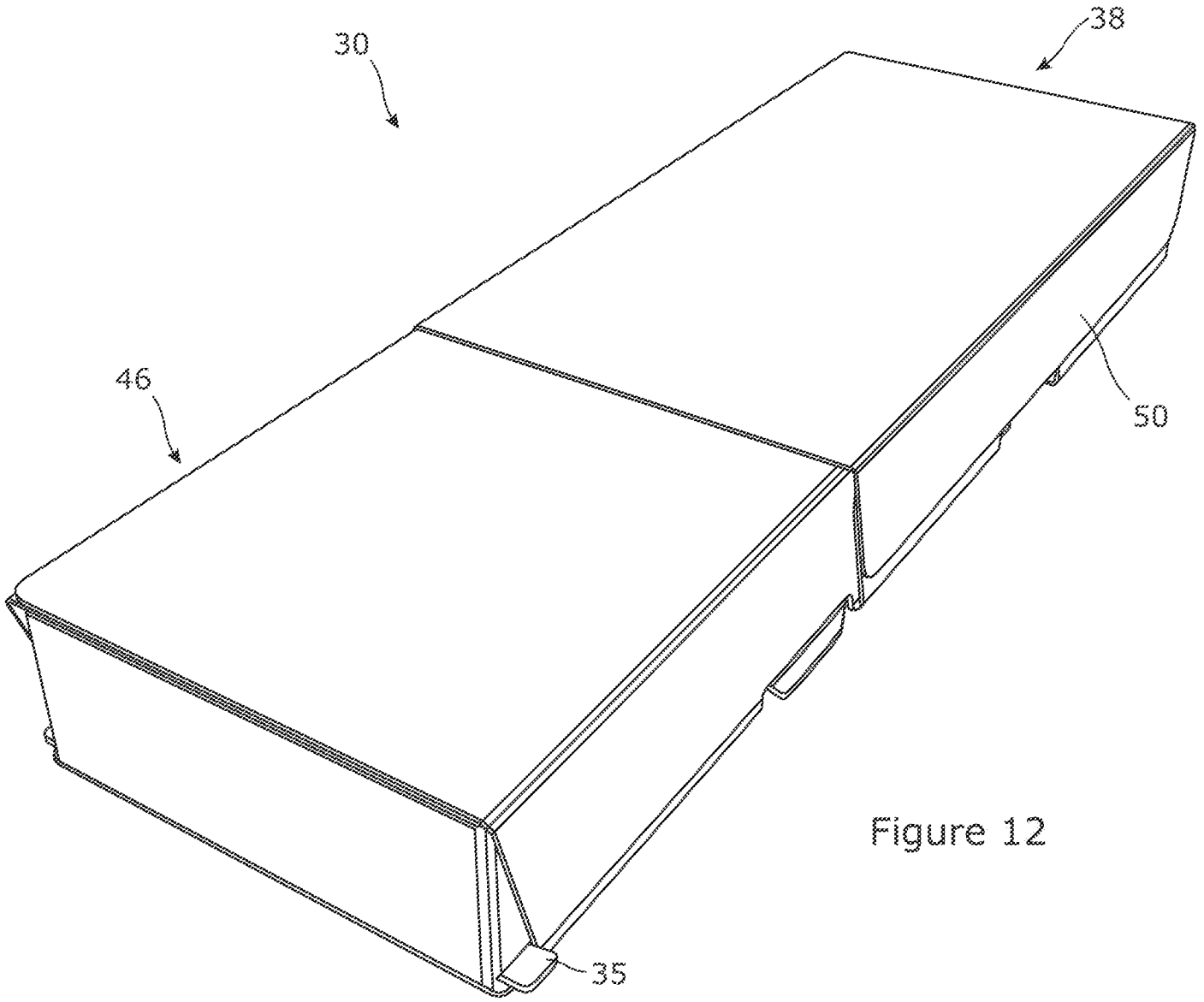
FIG. 12 shows the enhanced package of FIG. 1, with the primary package partially inserted into the secondary structure.

To assemble the enhanced package 30, as shown in FIG. 12, the primary package 46 is provided and is inserted into the secondary sleeve 50 of the secondary structure 38, with a rear end of the primary package 46 (i.e. the end opposite the forward stop formations 35) being inserted into the front end of the sleeve 50. The secondary sleeve 50 is pushed over the primary package 46 until the package 30 reaches the configuration of FIG. 1. The primary package 46 may be inserted into the secondary structure 38 as a single pre-assembled package with the primary structure 36 and the support 32 inserted together simultaneously, or the primary structure 36 and the support 32 may be inserted sequentially, for example with the primary structure 36 being inserted first, and the support 32 being inserted subsequently. In other embodiments, the secondary structure 38 may be wrapped around the primary package.

Referring back to FIG. 1, this configuration is the fully-closed or secure configuration. In this configuration the secondary structure covers the primary structure. Front and rear ends of the primary and secondary structures align, such that the primary structure is almost completely covered by the secondary structure and hence is invisible to the user. The visual effect of the exterior of the package is thereby dominated by the secondary structure.

The internal dimensions of the secondary structure 38 are substantially the same as, or only slightly larger than, the external dimensions of the primary structure 36. The secondary structure 38 therefore fits over the primary structure 36 with a tight frictional fit. In this way, the secondary structure 38 grips the primary structure 36 to guard against subsequent movement of the primary structure 36 relative to the secondary structure 38.

Figure 13:
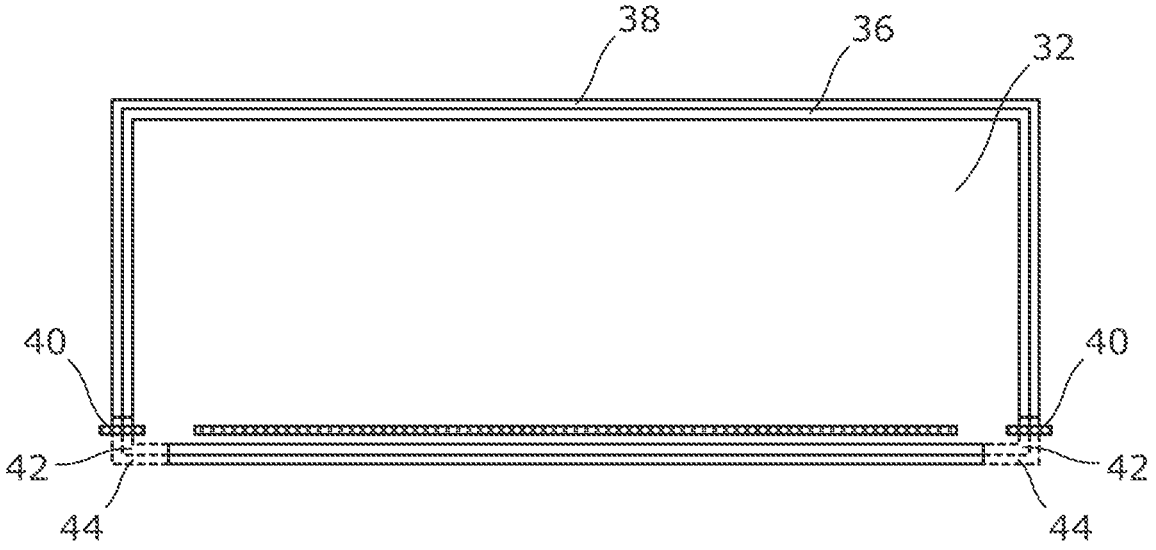
FIG. 13 is a cross-sectional view of the enhanced package of FIG. 1, showing latches of the support protruding through apertures of the primary and secondary structures

Apertures 42, 44 of the primary and secondary structures 36, 38 align with each other, and also align with the latches 40 of the tab member 34. As shown in FIG. 13, the latches 40 of the tab member 34 protrude through the apertures 42, 44 of the primary and secondary structures 36, 38. The alignment of the latch features 40, 42, 44 allows the latches 40 of the tab member 34 to be disengaged from the apertures 42 of the primary structure through or via the secondary structure 38. In particular, disengagement is permitted through the apertures 44 of the secondary structure 38.

Front edges of the latch formations 40 facing the abutment surfaces on the walls surrounding the apertures 42, 44 of both the primary and secondary structures 36, 38.

If a user attempts to move the support 32 and hence the tab member 34 in the direction of arrow X when the latch formations 40 are in their engaged state, the front edges of the latch formations 40 bear against the respective abutment edges of the apertures 42, 44 which prevents movement of the tab member 34 in the direction of arrow X.

Figure 14:
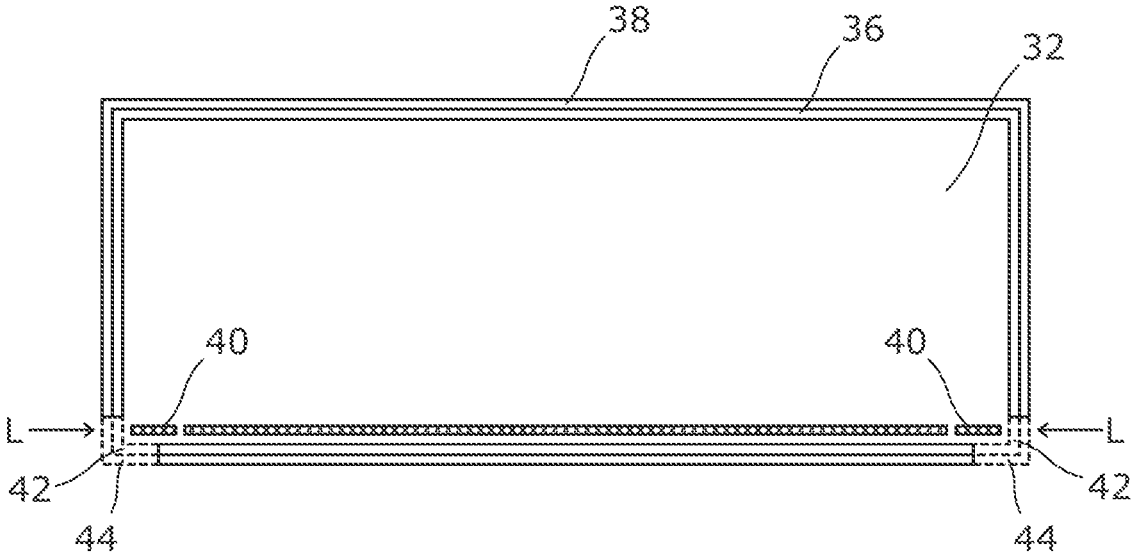
FIG. 14 is a cross-sectional view of the enhanced package of FIG. 1, showing the latches of the support after they have been disengaged from the apertures of the primary and secondary structures by movement in an unlatching direction.
Figure 15:
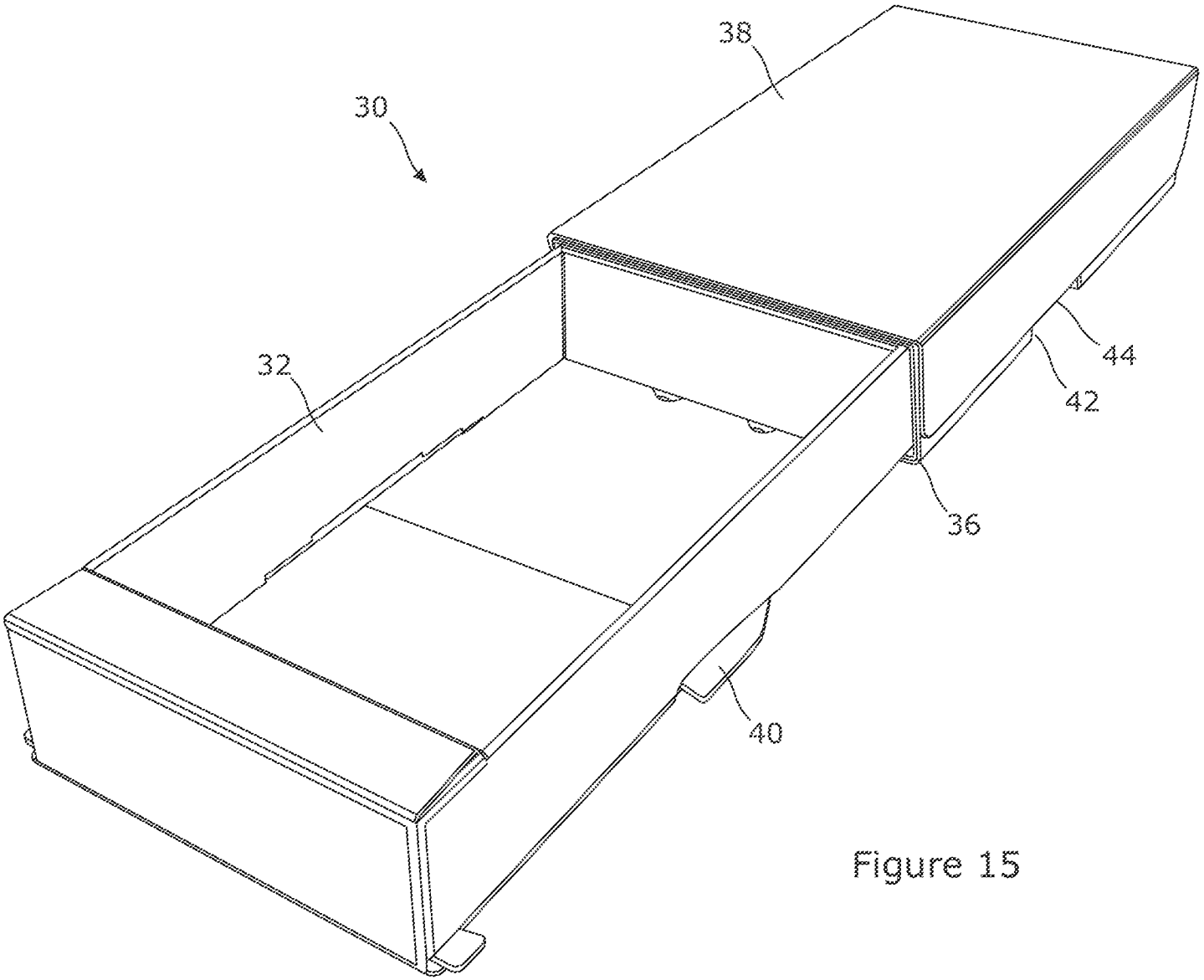
FIG. 15 is a perspective view of the enhanced package of FIG. 1 in an open configuration.

Movement of the support 32 in direction X can only occur when the latch formations 40 are simultaneously brought into their disengaged state by a user pressing the latch formations 40 towards each other in a squeezing action between a user's thumb and middle finger, in the unlatching direction L, as shown in FIG. 14. As the user squeezes the latches 40, the latches 40 move in the unlatching direction L.

By moving the latches 40 in the unlatching direction, the latches 40 are moved into the disengaged state. In the disengaged state, the front edges of the latch formations 40 are arranged inwardly of the side walls of both the secondary structure 38 and the primary structure 36. In this way, when the user moves the support 32 in the direction of arrow X, the front edges of the latches 40 do not abut the abutment edges of the apertures 42, 44, and the support 32 is free to slide within the sleeve 300 in the opening direction X. The support 32 can therefore slide relative to the both the secondary structure 38 and the primary structure 36 into an open configuration shown in FIG. 15.

The secondary structure 38 therefore does not impede the child resistant functionality of the primary package 44. In fact, surprisingly, the secondary sleeve 38 acts in synergy with the primary structure 36 to have a beneficial effect on the child-resistance of the package 30 in the following ways.

Firstly, the secondary sleeve 38 acts as a distraction to a child attempting to enter the package 30. When presented with the package 30 and attempting to enter it, the child will focus on the outermost structure and attempt to rip or tear that structure to gain entry. Even if the child is successful in this endeavor, the child will be faced with a fully child-resistant package underneath. This adds to the time a child would take attempting to open the package, giving more time for the child to be discovered and stopped. In this way, the secondary structure 38 can act as a 'sacrificial sleeve'.

Secondly, the user must depress the latches 40 sufficiently to pass through not only the aperture 42 of the primary structure 36, but also the aperture 44 of the secondary structure 38. In this way a greater degree of depression, and hence greater strength and dexterity, is required.

Furthermore, the secondary structure 38 allows greater flexibility in the appearance of the package 30. Identical primary packages 44 can be produced with identical outward appearances, and then combined with different secondary structures 38 to provide different appearances. The different secondary structures may be of different materials, different surface effects, different colours or have different printed images to fulfill a particular retailer's needs.

A particular advantage is that a stock of primary packages may be constantly produced and stored, without knowing in advance what appearance is required. The secondary structure may then be produced to provide a bespoke appearance on demand. This also facilitates small-batch production of packages having a particular appearance.

Primary packages may also be manufactured a first manufacturing location, and then shipped to a second location where the secondary structures are applied. For example, a retailer may provide and apply its own secondary structures at the second location.

Finally, the use of the combined primary and secondary structures allows a package having an appearance of a non-child-resistant material (for example a card that is relatively easy to tear) by virtue of the secondary structure, whilst still providing full child resistance by virtue of the primary structure, which may be made of a child-resistant material that will be covered by the secondary structure.

It may be desirable to take additional measures to secure the secondary structure 38 to the primary structure 36, to guard against the primary structure 36 sliding out of the secondary structure 38 along with the support 32.

Figure 16:
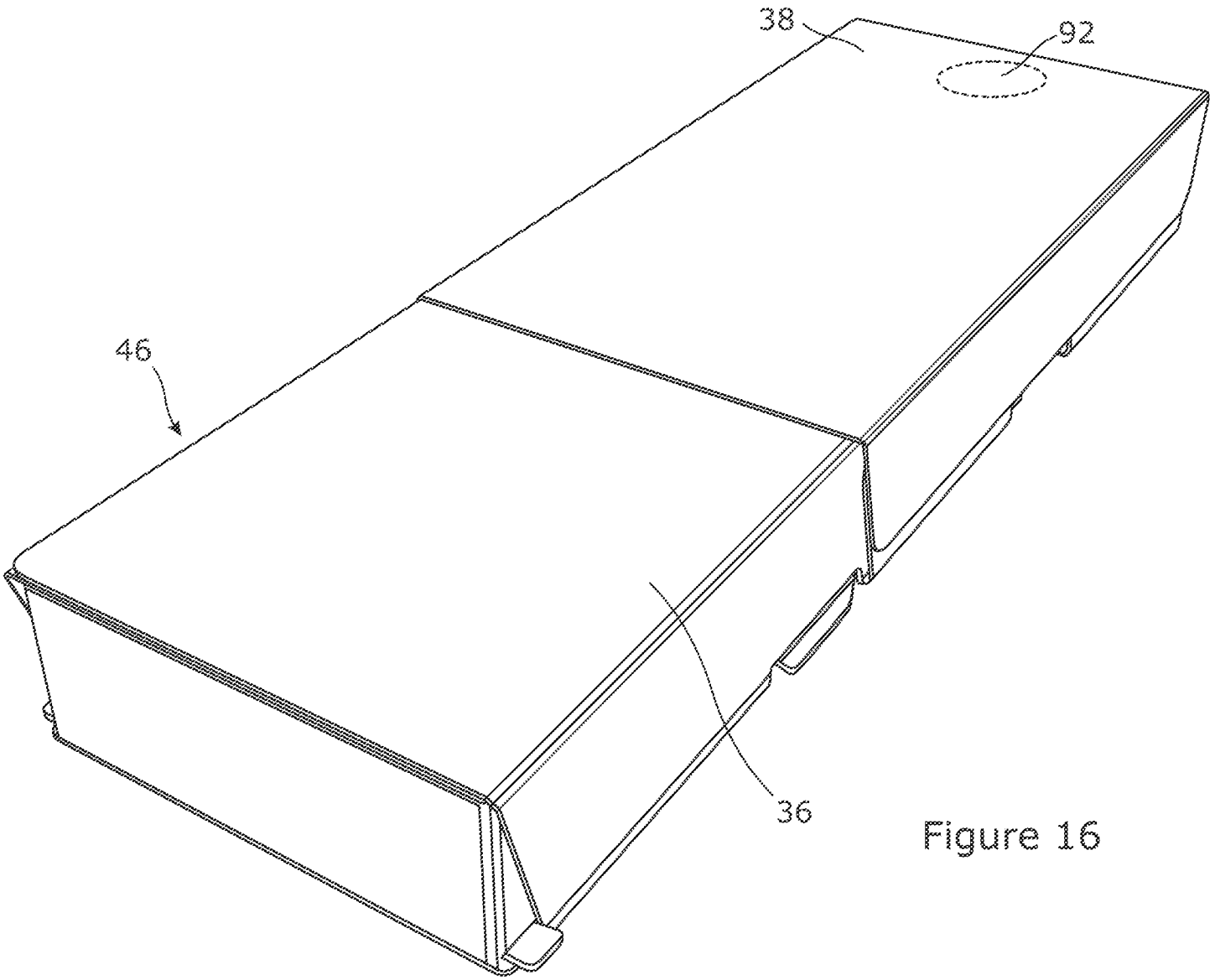
FIG. 16 is a perspective view of an enhanced package according to an embodiment, where the primary structure is coupled to the secondary structure by an adhesive.

To this end, as illustrated in FIG. 16, the primary structure 36 may be coupled to the secondary structure 38. In this example, the primary structure 36 may be coupled to the secondary structure 38 by an adhesive 92. The adhesive 92 is applied at a rear end of the package. The adhesive may be initially applied to an interior surface of the secondary structure 38. When the primary structure 36 is pushed into the secondary structure 38, the adhesive is between the primary structure 36 and the secondary structure 38. The adhesive is preferably displaced slightly from the end of the package to avoid any adhesion between the structures 36, 38 and the support 32.

Figure 17:
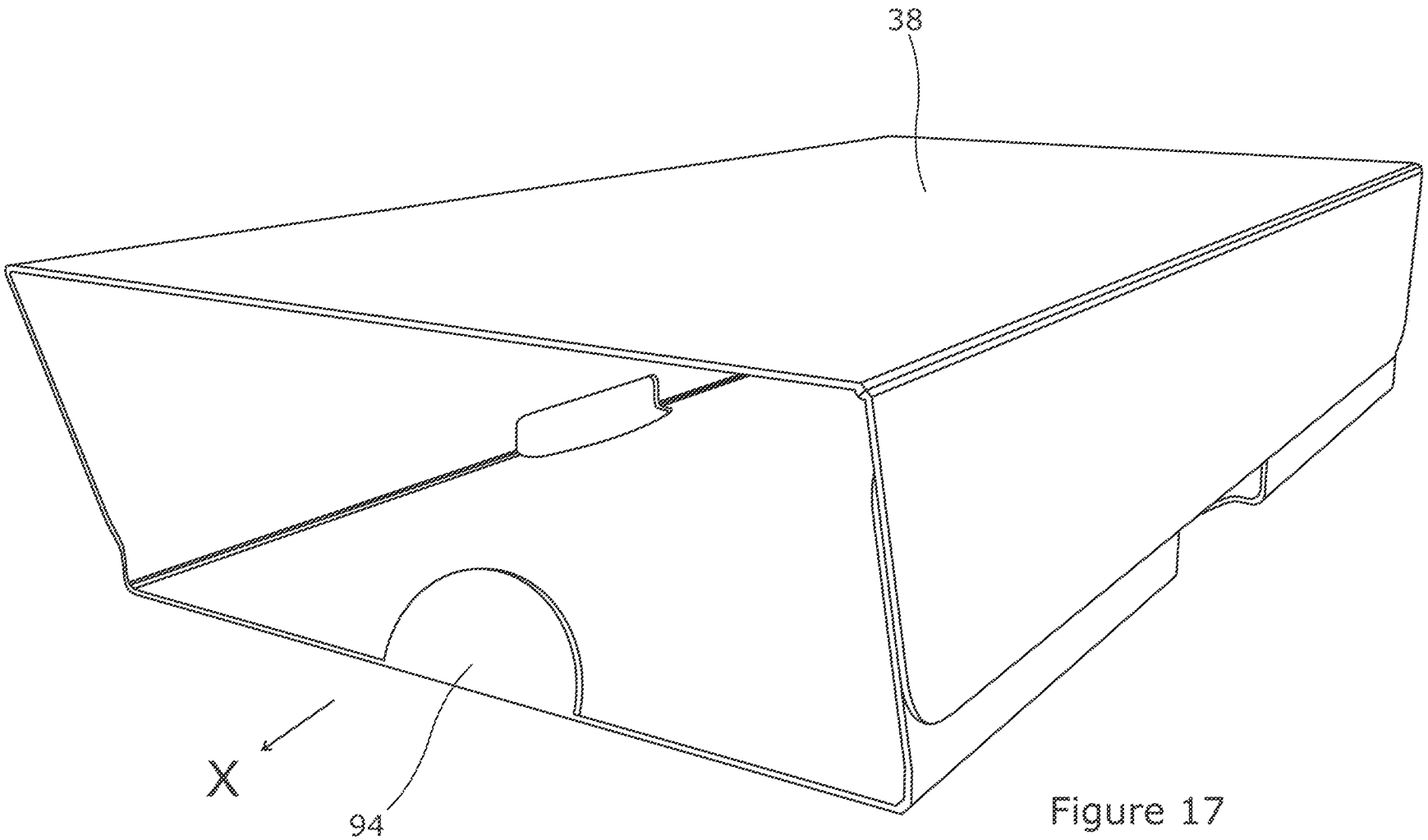
FIG. 17 is a perspective view of a secondary structure according to an embodiment, where the secondary structure includes a coupling flap for engaging with a primary structure.

Alternatively, as shown in FIG. 17, at a front end of the sleeve 50 of the secondary structure 38, the secondary structure 38 may be provided with a means for engaging the primary structure 36. In this case, the means may be a coupling flap 94 that is joined to the secondary structure 38 by a fold. In the assembled package, the coupling flap 94 may be folded over a wall of the primary structure 36 to sit between the wall of the primary structure 36 and the support 32.

When the support 32 is pushed in the opening direction X, if the primary structure 36 begins to move with the support it will abut against the internal surface of the fold, which prevents further movement of the primary structure 36 with respect to the secondary structure 38.

Figure 18B:
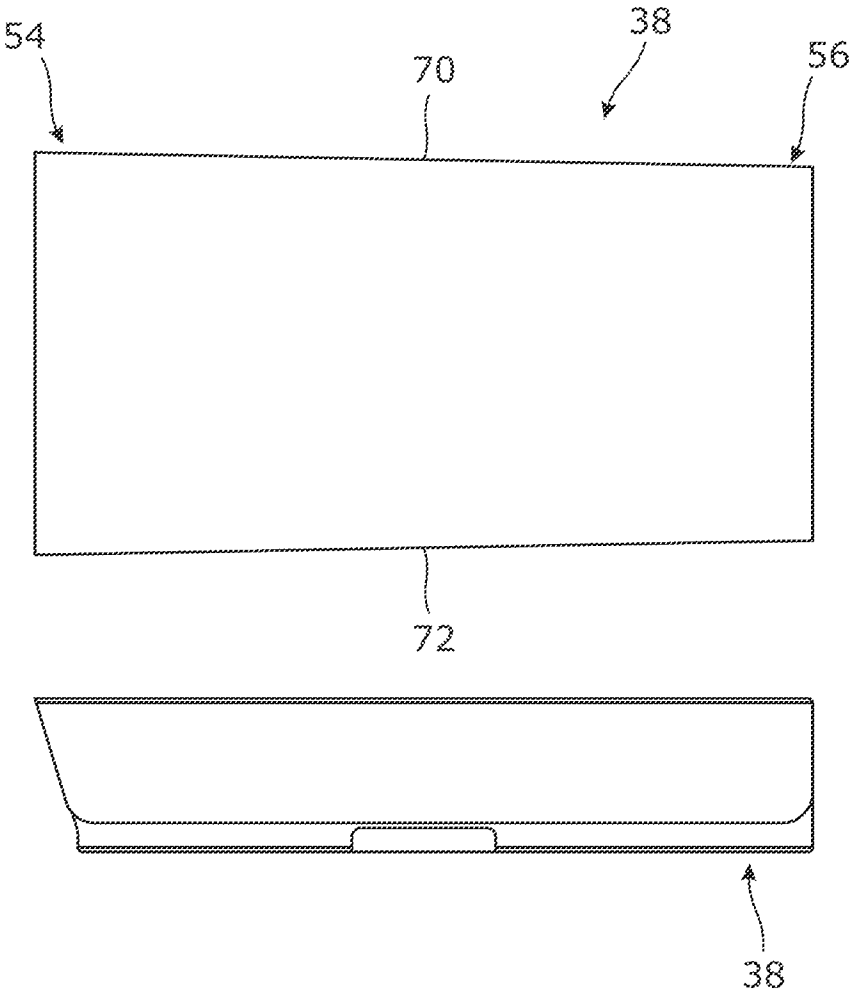
FIGS. 18*a* and 18*b* are side views of a secondary structure according to an embodiment, the secondary structure being tapered.
Figure 18A:
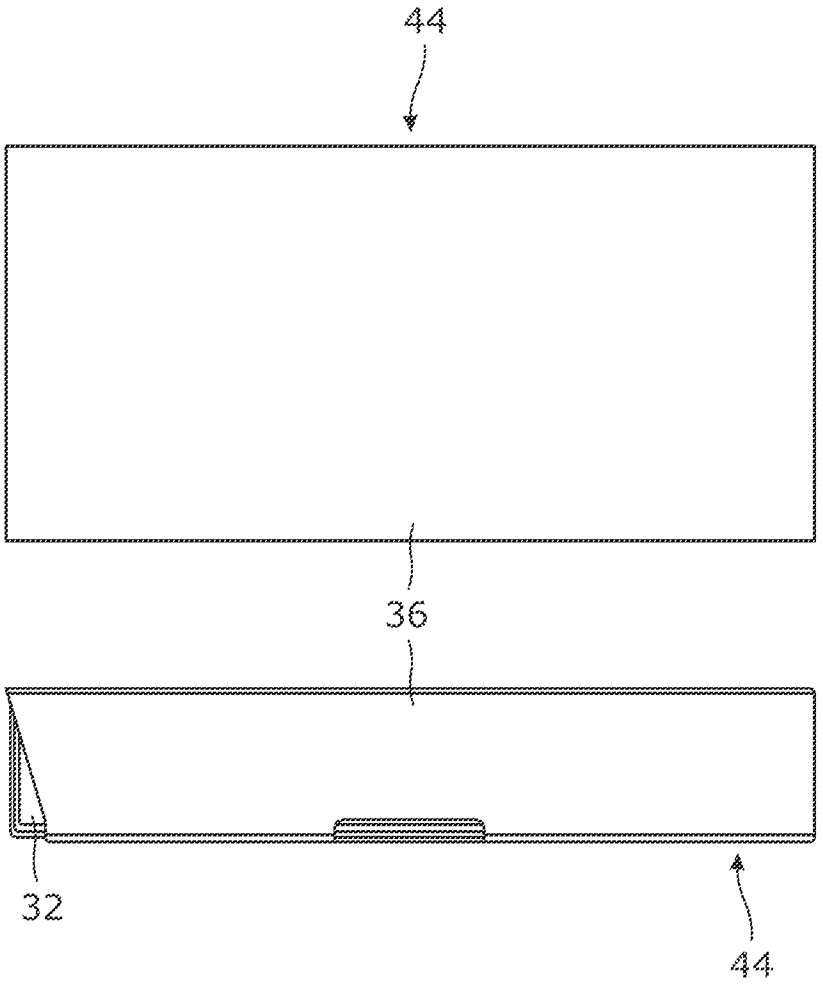

As a further alternative, as shown in FIGS. 18*a* and 18*b*, left and/or right side walls 70, 72 of the sleeve 50 of the secondary structure 38 may be slightly tapered from front to rear. In this way, a width of the sleeve 50 of the secondary structure 38 may be slightly less at a rear 36 of the sleeve 50 than at a front 54 of the sleeve 50. The taper may be for example between 0.5 and 5 degrees.

This tapering allows the primary package 44 to be slid easily into the sleeve 50 of the secondary structure 38 at the front 54 of the sleeve 50, while the narrower width at the rear of the sleeve allows a particularly tight and effective push-fit of the primary structure 36 within the sleeve 50 of the secondary structure 38, thereby guarding against movement of the primary structure 36 with respect to the secondary structure 38.

Alternatively or additionally to any of the above measures, steps may be taken to increase friction between the primary structure 36 and the secondary structure 38. For example, an exterior surface of the primary structure 36 and/or an interior surface of the secondary structure 38 may be a high-roughness surface. In particular, the exterior surface of the primary structure 36 and/or the interior surface of the secondary structure 38 may be of higher roughness than the exterior surface of the secondary structure 38.

Figure 19:
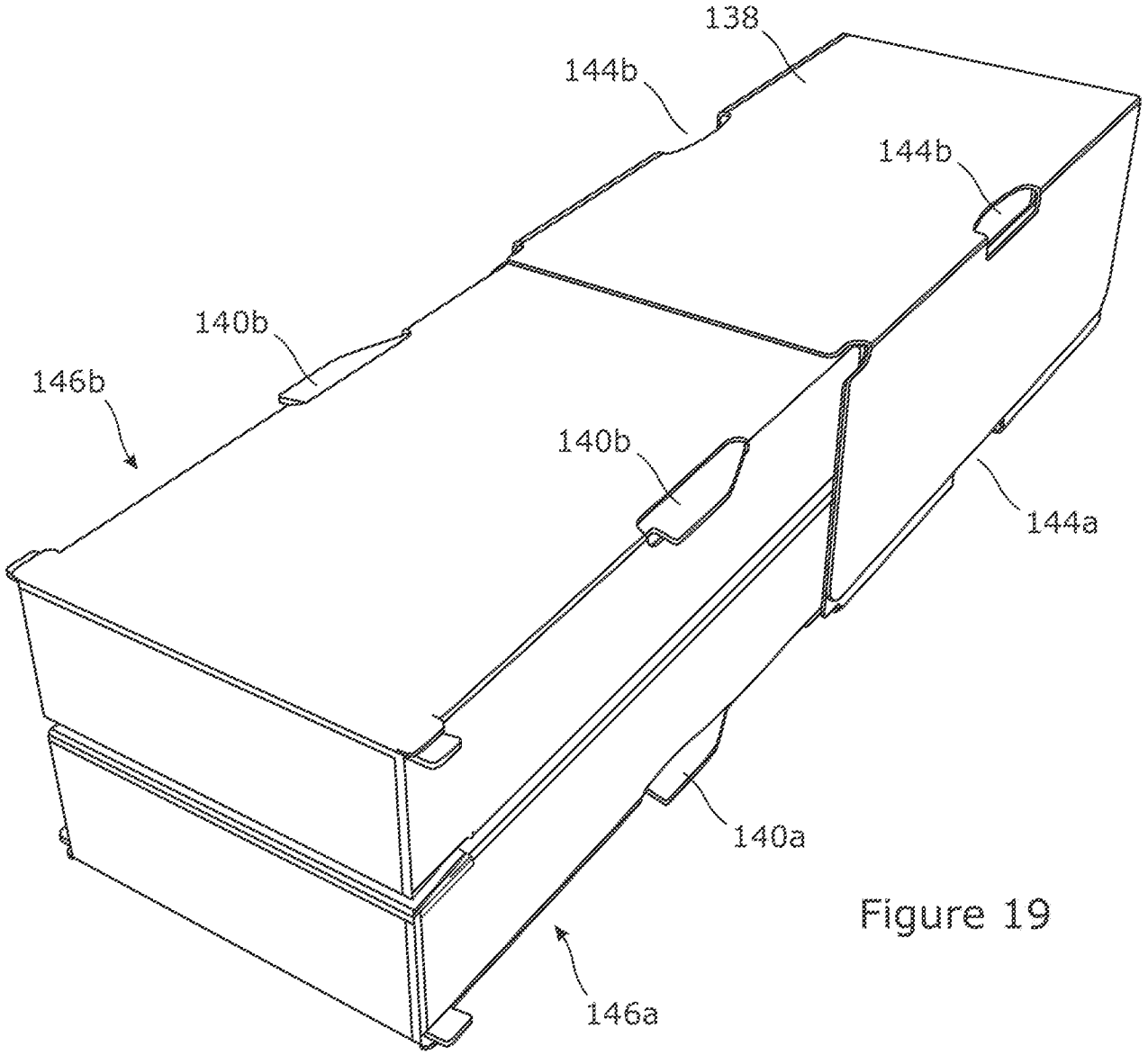
FIG. 19 is a perspective view of an enhanced package according to an embodiment, the enhanced package including two primary packages.

FIG. 19 illustrates an embodiment in which a plurality of primary packages 146*a*, 146*b* are housed in the same secondary structure 138: in this example, two primary packages 146*a*, 146*b*.

Figure 20:
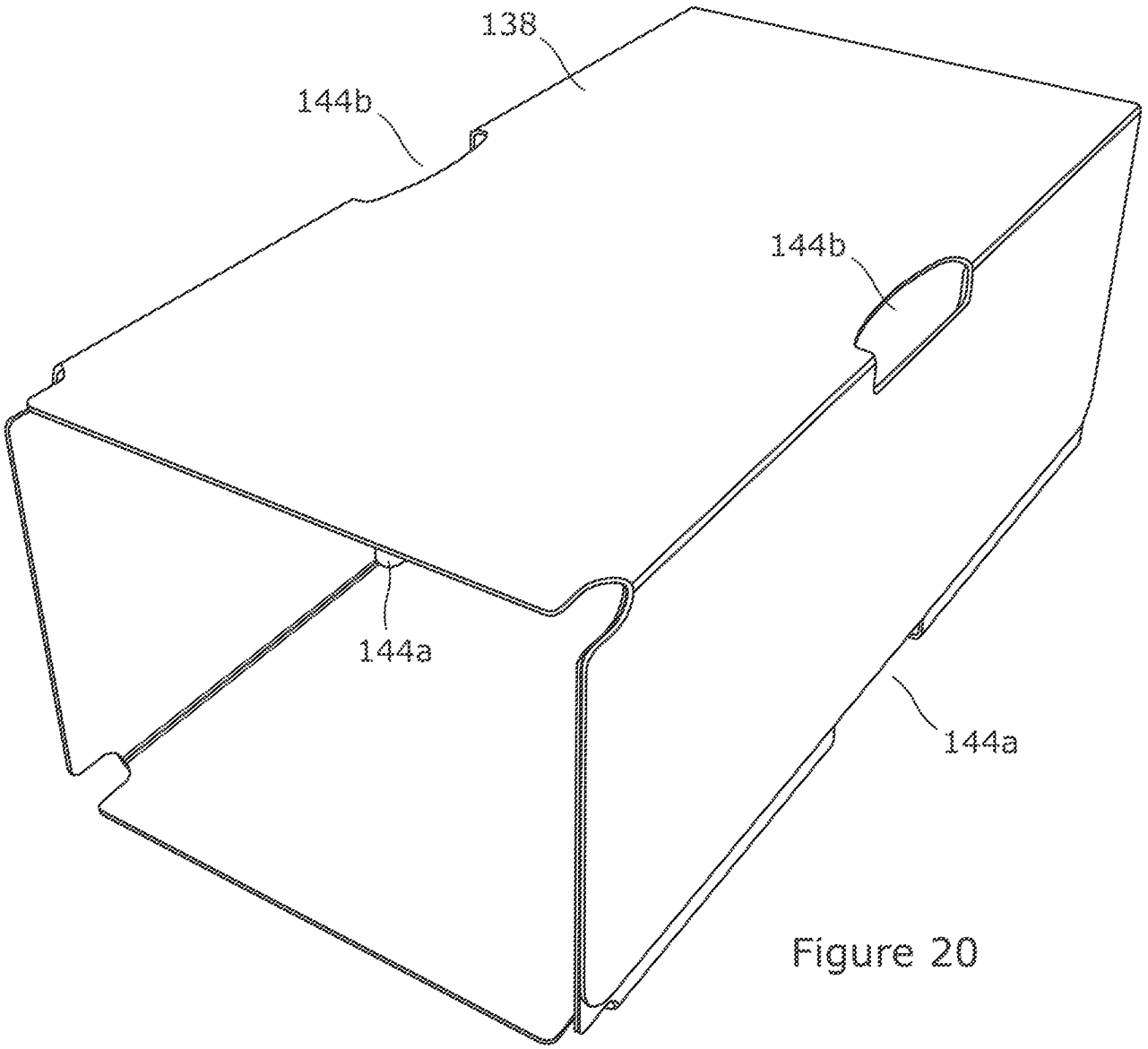
FIG. 20 is a perspective view of a secondary structure of the enhanced package of FIG. 19.

FIG. 20 illustrates the secondary structure 138 of the package of FIG. 19 in isolation. The secondary structure 138 is substantially the same as the secondary structure 38 described above, except for its dimensions and arrangement of apertures.

To accommodate multiple primary packages 146*a*, 146*b*, the secondary structure 138 has a greater height than the secondary structure 38 described above. In this embodiment, the secondary structure 138 has a height that is the same as the combined height of the two primary packages 146*a*, 146*b*. Since both primary packages 146*a*, 146*b* are the same height, the height of the secondary structure 138 is twice the height of each primary package 146*a*, 146*b*. To accommodate different numbers of primary packages, the height of the secondary structure 138 may correspond to other multiples of the height of a primary package 146.

In the embodiment of FIG. 19, both primary packages 146*a*, 146*b* comprise co-operable latch features 140*a*, 142*a*, 140*b*, 142*b*. To allow disabling of the latch features 140*a*, 140*b*, of each primary package 146*a*, 146*b*, the secondary structure 138 comprises two sets of disengagement regions, and hence two sets of apertures 144*a*, 144*b*. A first set of apertures comprises lower left and right apertures 144*a* arranged along a lower edge of the secondary structure 138, and a second set of apertures comprises upper left and right apertures 144*b* at along an upper edge of the secondary structure 138. Each set of upper and lower apertures 144*a*,

144*b* aligns with latch features 140*a*, 140*b*, of a primary package 146*a*, 146*b* to allow disengagement of the latch features 140*a*, 140*b*, through the respective apertures 144*a*, 144*b*.

Figure 21:
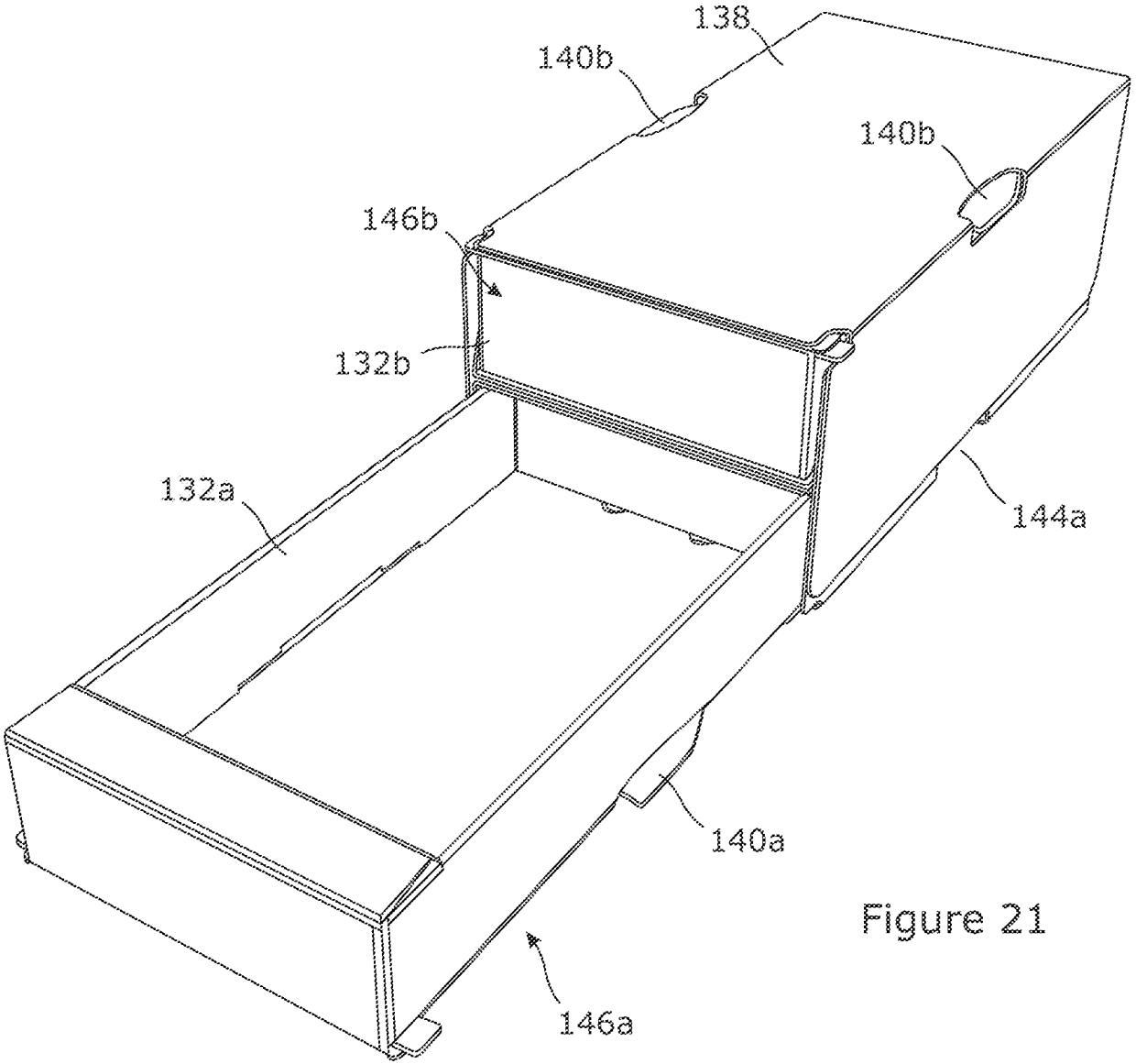
FIG. 21 is a perspective view of the enhanced package of FIG. 19, showing one of the primary packages in an access position.

To access the contents of a first or lower primary package 146*a*, the user depresses the latches 140*a* of the first primary package 146*a* through the lower apertures 144*a* along the lower edge of the secondary structure 138. With the latches 140*a* disengaged, the user can push the support 132*a* of the lower primary package 136*a* out of the primary sleeve 134*a* to access its contents, as shown in FIG. 21.

To access the contents of a second or upper primary package 146*b*, the user depresses the latches 140*b* of the second primary package 146*b* through the upper apertures 144*b* along the upper edge of the secondary structure 138. With the latches 140*b* disengaged, the user can push the support 132*b* of the upper primary package 146*b* out of the primary sleeve 134*b* to access its contents.

This arrangement conveniently allows multiple primary packages to be housed in the same sleeve, providing a unified branding and overall appearance. The primary packages can be "mixed and matched" as desired at the point of assembly of the entire package. For example, multiple primary packages can be manufactured and filled with contents, and then at a later time primary packages can be selected and arranged together in a sleeve for subsequent use or sale, according to immediate trends or demands.

Figure 22:
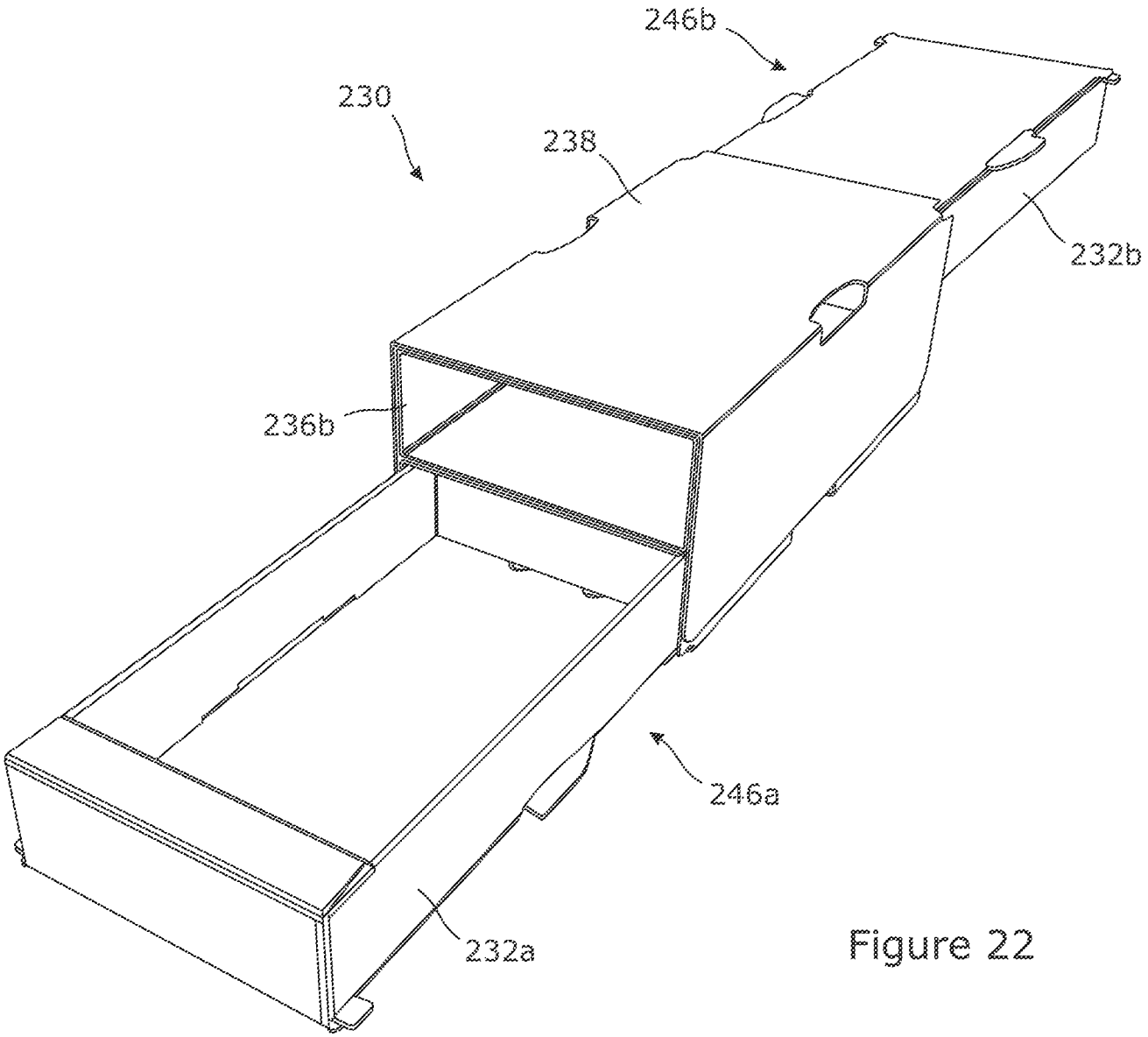
FIG. 22 is a perspective view of an enhanced package having two primary packages, showing both primary packages in access positions.

In the embodiment of FIG. 19 the supports 132*a*, 132*b* of the primary packages 146*a*, 146*b* are arranged to be pushed out of the primary and secondary structures 134*a*, 134*b*, 138 in the same direction. FIG. 22 illustrates an embodiment in which the supports 232*a*, 232*b* of the primary packages 246*a*, 246*b* are arranged to be pushed out of the primary and secondary structures 236*a*, 236*b*, 238 in opposite direction. To this end, the upper and lower primary packages 246*a*, 246*b* are arranged to face in opposite directions within the secondary structure 238, so that the first support 232*a* is movable out of the enhanced package 230 in a first direction, and the second support 232*b* is movable out of the package in a second direction opposite to the first direction.

Although in the package of FIG. 19, both primary packages 146*a*, 146*b* comprise latch features 140*a*, 140*b*, and hence have child-resistant functionality, this need not necessarily be the case. It may be desirable to house child-resistant and non-child-resistant packages together within the same secondary structure 138, for example if not all primary packages contain hazardous materials.

In this case, the secondary structure is substantially the same as the secondary structure of FIG. 20 above, except that it comprises only one set of disabling regions, and hence only one set of apertures. For example, if the lower primary package is the child-resistant package, the apertures are arranged only at the lower edge of the secondary structure, to align with the latch features of the lower primary package.

The user can access the contents of the lower, child-resistant primary package, by depressing the latches of the lower primary package through the lower apertures along the lower edge of the package, and pushing the support of the lower primary package out of the primary sleeve as described above. Since the upper primary package has no child resistant functionality, the user may simply push the support of the upper primary package out of the primary sleeve to access its contents.

In this embodiment, the secondary structure conveniently allows a mixture of child-resistant and non-child-resistant packages to be housed together in the same sleeve. The child-resistant functionality of the child-resistant package is not compromised or affected by incorporation with the non-child resistant package.

In the embodiments described above the disengagement regions of the secondary structure are defined by apertures. However, this need not necessarily be the case, and the disengagement regions 40 may be defined by any suitable structure that permits disengagement of the latch formations while the secondary structure is in place.

For example, the apertures may be omitted, and the disengagement regions of the secondary structure may cover the latch formations. In this case, the disengagement regions may be defined by flexible walls of the secondary structure. The user may press on the secondary structure in the disengagement region, and the pressure of the secondary structure on the latches may push the latches in the unlatching direction. In this way, the latch features are disengageable through or via the secondary structure.

It will be appreciated that in this case, at least in the region of the latches, the secondary structure must be sufficiently flexible to allow the secondary structure to move against and with the latches as the sides of the secondary structure are pushed in the unlatching direction. For this reason, it may be preferred to arrange the latches, and hence the disengagement region, at the center of the package, where the greatest displacement of the wall is possible. In this way, the secondary structure may be of constant thickness, but the greater displacement permitted at the center of the package results in a disengagement region in the area of the latches. Other embodiment are envisaged in which the disengagement region may be defined by other features that provide the required flexibility: for example by regions of reduced thickness or different material, or by regions that are provided with slits, cuts, scores, folds, openings, perforations, for example above and/or below and/or to the sides of the latches.

If the secondary structure is arranged to cover the latches, the secondary structure may be provided with markings or other features to indicate the location of the latches.

In the embodiments described the secondary structure is open at both ends. However, this need not be the case. For example, one end of the secondary structure may be closed off by an end wall. In particular, if the support is configured to be movable out of a first end of the enhanced package, the secondary structure may be closed off at the second end. The second end may be completely closed, or the second end may be partially close. For example, the closure at the second end may be provided with an opening to allow the user limited access to the support via the partially closed end that is sufficient to push the support out of the package through the first end.

In other embodiments, the first end of the package, through which the support may be pushed out of the package, may be provided with a removable closure. For example, the first end may be provided with a closure that comprises a perforated strip, such that a user can tear the strip to compromise the closure, thereby allowing the support to be pushed out of the first end. The perforated strip also provides a convenient tamper-evident seal.

The secondary support may be provided with any appropriate design, which may include functional or aesthetic appendages. For example, a surface of the secondary support may be provided with a cover flap that can fold against the surface, and fold away from the surface to reveal additional printed materials. The cover flap can also be used to support a booklet or information sheet.

Walls of the secondary support can be provided with extension sections that extend a wall beyond the rest of the package in any direction. For example, a base wall of the secondary support may be longer than a front wall of the secondary support, such that the base wall extends upwardly beyond the front wall. The extended region of the base wall may be provided with printed material, or with a formation such as a Euro-hook to allow the enhanced package to be suspended at a retail stand.

If such appendages were provided on the primary structure, they could compromise the child-resistance of the package by providing leverage areas that a child could use to leverage access to the package. However, such features can be safely provided on the secondary structure without compromising the child resistance provided by the primary structure.

Although in the embodiment shown the primary package is substantially the same as the package of FIGS. 1 to 14 and 15A to 15D of WO2017/129996, this need not necessarily be the case. The secondary structure may be combined with any suitable primary package comprising a latch arrangement. For example, the planar tab member need not be movable with the support, but may instead move in the opposite direction to the support, as described in PCT/GB2015/052166. In other embodiments, the latches of the primary package need not be provided by virtue of a planar tab member at all. The latches may for example be integral with the support.

Figure 23:
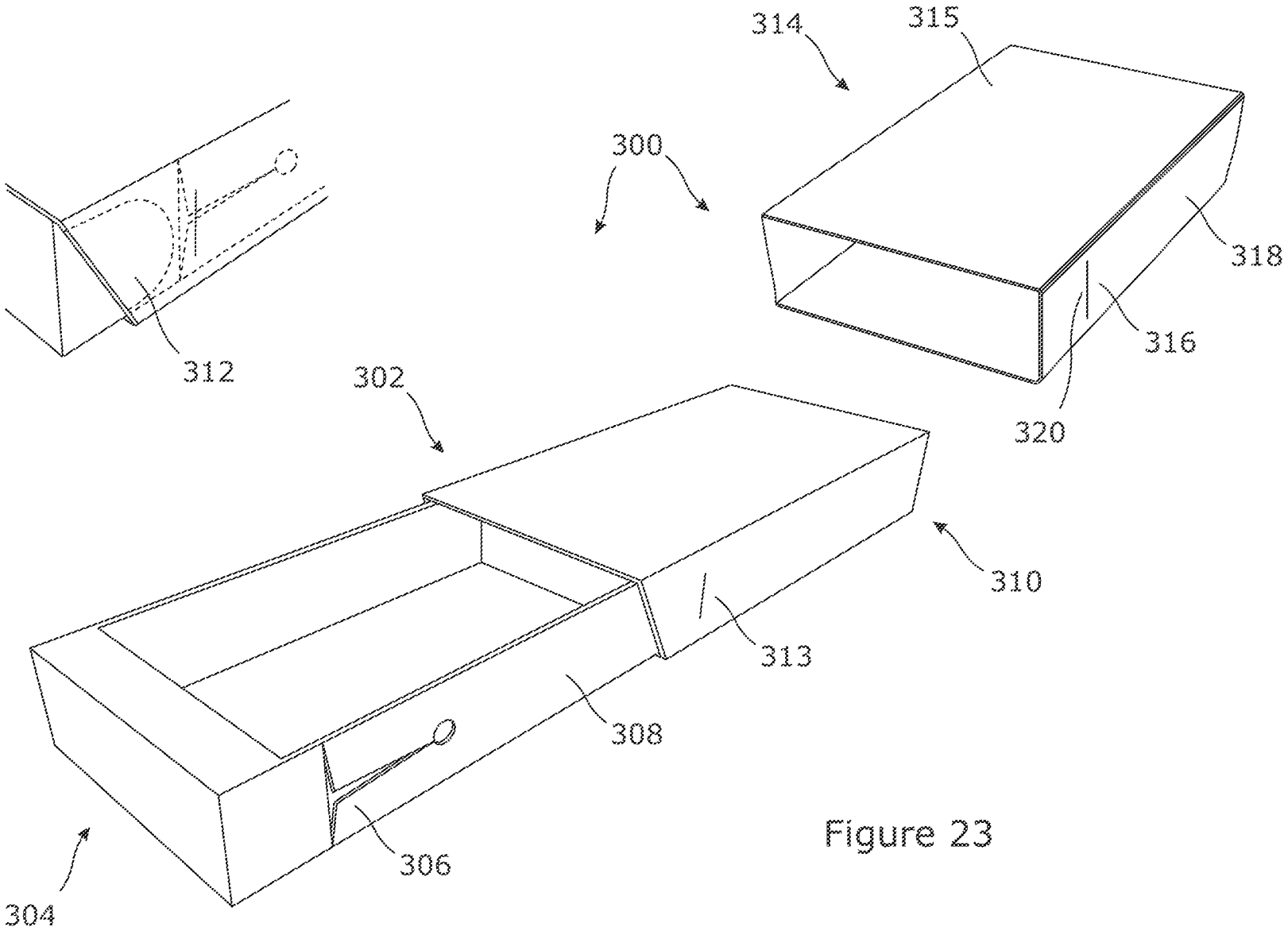
FIGS. 23 and 24 are perspective views of an enhanced package of another embodiment.
Figure 24:
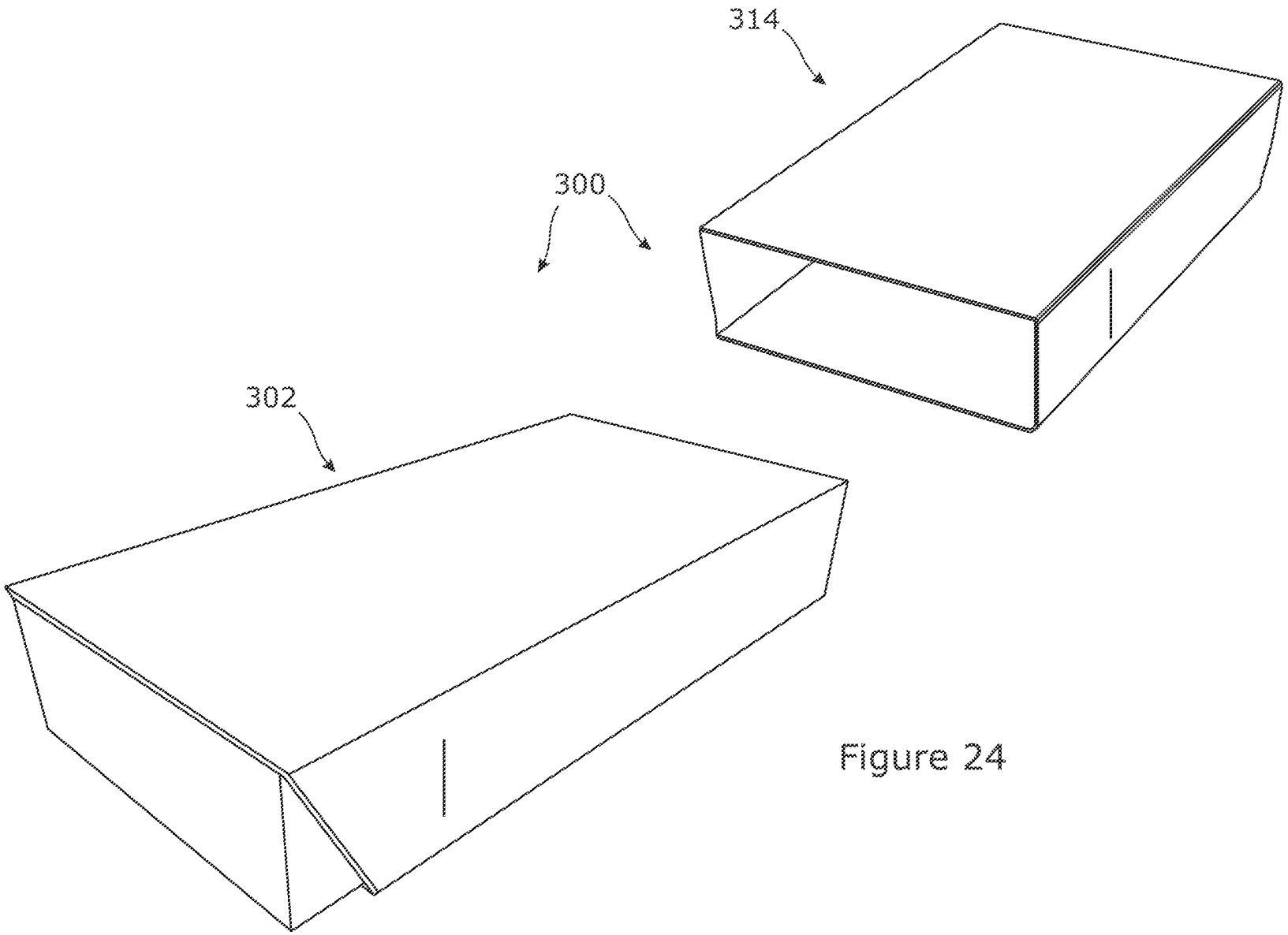
Figure 25:
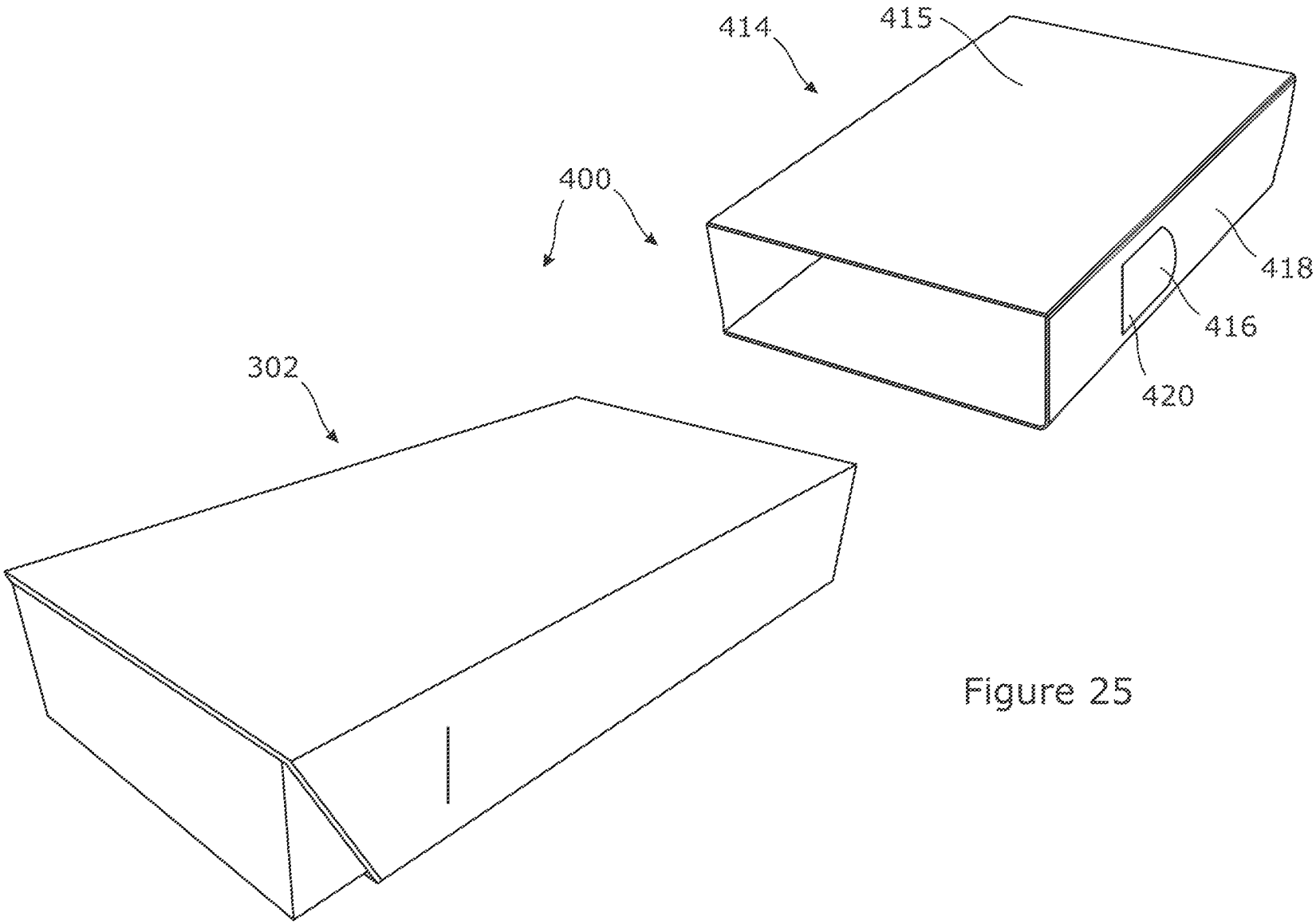
FIG. 25 is a perspective view of an enhanced package of another embodiment.

An example of such alternative packages are shown in FIGS. 23, 24 and 25.

In such alternative packages 300, 400, the primary package 302 comprises a support 304 having integral latches 306, in this case arranged on left and right sides of the support 304 and integral with side walls 308 of the support 304. The primary structure 310 comprises engagement features for engaging the latches 306 of the support 304. In this example, the engagement features are provided by flaps 312 on the primary package 302 that are directed rearwardly to provide a rearward facing abutment surface against which the latch 306 can abut (see inset to FIG. 23). The primary structure 310 comprises a primary disengagement region 313 that lies over the latches 306 when the primary package 302 is in the closed configuration. When a user depresses the side walls of the primary package 302 in the area of the primary disengagement region 313, the side walls will be deflected inwards, pushing the latches 306 inwardly, thereby disengaging the latches 306.

In FIGS. 23 and 24, the secondary structure 314 of the package 300 takes the form of a sleeve 315 having disengagement region 316 on its left and right side walls 318. A vertical slit 320 is provided in each side wall 318. The slit provides a disengagement region 316 in the side wall 318 of the sleeve 315, extending generally rearwardly from the slit 320. By virtue of the slit 320, the side wall 318 is more flexible in this disengagement region 316. When the primary package 302 is housed in the sleeve 315, the disengagement region 316 on the sleeve 315 overlies the primary disengagement region 313 on the primary package 302. In this way, pressing the disengagement region 316 of the sleeve 315 causes the side walls 318 of the sleeve 315 to move inwardly. This inward movement depresses the primary disengagement region 313 of the primary package 302, thereby disengaging the latches 306 and allowing the support 304 to move out of the primary structure 310.

In FIG. 25, the secondary structure 414 differs in that the disengagement region 416 is defined by an opening or aperture in the sleeve 415, which allows a user direct access to the primary disengagement regions 313 of the primary package 302. In this way, a user can access and depress the primary disengagement regions 313 of the primary package 302 directly through the disengagement regions 416 of the sleeve 415.

It is intended that subject matter disclosed in particular portions herein can be combined with the subject matter of one or more of other portions herein as long as such combinations are not mutually exclusive or inoperable. In addition, many variations, enhancements and modifications of the concepts described herein are possible. The terms and descriptions used above are set forth by way of illustration only and are not meant as limitations. Those skilled in the art will recognize that many variations can be made to the details of the above-described embodiments without departing from the underlying principles of the invention. Other variations and modifications will be apparent within the scope of the appended claims.

The invention claimed is:

1. A latchable package comprising:

a support for supporting one or more items;

a primary structure for selectively blocking access to the one or more items; and a secondary structure arrangeable to cover at least a part of the primary structure, wherein the support is movable in an opening direction from a first position in which the primary structure blocks access to the one or more items to a second position in which the one or more items are accessibly clear of the primary structure;

wherein the support and the primary structure comprise co-operating latch features configured to engage when the support and the primary structure are arranged in the first position to prevent movement of the support in the opening direction, and configured to disengage on moving at least one latch feature in an unlatching direction to permit movement of the support in the opening direction;

wherein the secondary structure comprises a disengagement region that is arrangeable to at least partially align with the latch features when the support and the primary structure are arranged in the first position, and that is configured to permit disengagement of the latch features of the support and the primary structure when the disengagement region is at least partially aligned with the latch features;

a second support for supporting one or more items;

a second primary structure for selectively blocking access to the one or more items in the second support, and wherein the secondary structure is further arrangeable to cover at least a part of the second primary structure; and wherein the second primary structure and the second support comprise second co-operating latch features, and wherein the secondary structure comprises a second disengagement region that is arrangeable to at least partially align with the second latch features when the second support and the second primary structure are arranged in the first position, and that is configured to permit disengagement of the second latch features of the second support and the second primary structure when the second disengagement region is at least partially aligned with the second latch features.

2. A latchable package as claimed in claim 1, wherein the disengagement region is configured to permit disengagement of the latch features of the support and the primary structure through or via the disengagement region.

3. A latchable package as claimed in claim 1, wherein the disengagement region is defined by an aperture or slit in the secondary structure.

4. A latchable package as claimed in claim 3, wherein the disengagement region is defined by an aperture in the secondary structure, and a part of the primary structure is accessible through the aperture when the support and the primary structure are arranged in the first position and the disengagement region of the secondary structure is aligned with the latch features of the support and the primary structure.

5. A latchable package as claimed in claim 4, wherein the latch feature of the support is accessible through the aperture.

6. A latchable package as claimed in claim 1, wherein the disengagement region comprises a wall region that substantially overlies the latch features when the support and the primary structure are arranged in the first position, the wall region being configured to be movable in the unlatching direction.

7. A latchable package as claimed in claim 6, wherein at least a portion of the wall region that overlies the at least one latch feature is flexible.

8. A latchable package as claimed in claim 1, wherein the secondary structure has a thickness of between 0.1 mm and 2 mm.

9. A latchable package as claimed in claim 1, wherein a front end of the secondary structure is substantially aligned with a front end of the primary structure when the support and the primary structure are arranged in the first position, and/or wherein a rear end of secondary structure is substantially aligned with a rear end of the primary structure when the support and the primary structure are arranged in the first position.

10. A latchable package as claimed in claim 1, wherein the secondary structure has self-supporting rigidity.

11. A latchable package as claimed in claim 1, wherein the support comprises a first stop feature configured to limit further movement of the support in the opening direction from the second position, and/or a second stop feature to limit movement of the support in a direction opposite the opening direction from the first position.

12. A latchable package as claimed in claim 1, wherein the secondary structure is coupled to the primary structure.

13. A latchable package as claimed in claim 12, wherein the secondary structure is coupled to the primary structure by a coupling flap, the coupling flap joined to the secondary structure by a fold.

14. A latchable package as claimed in claim 1, wherein the secondary structure surrounds the primary structure in a close fit to provide a frictional engagement between the primary structure and the secondary structure.

15. A latchable package as claimed in claim 1, wherein a coefficient of friction between the primary structure and the secondary structure is higher than a coefficient of friction between the primary structure and the support.

16. A latchable package as claimed in claim 1, wherein the secondary structure comprises opposing upper and lower walls, and wherein the upper wall and lower walls are of different lengths.

17. A latchable package as claimed in claim 1, wherein the secondary structure has a different surface finish to that of the primary structure.

18. A latchable package as claimed in claim 1, wherein the secondary structure comprises a closure flap that is selectively arrangeable to at least partially cover an end of the latchable package when the support and the primary structure are arranged in the first position, to selectively prevent movement of the support in the opening direction.

19. A latchable package as claimed in claim 1, wherein a rear end of the secondary structure comprises a secondary access opening that permits access to a rear end of the support when the support and the primary structure are arranged in the first position.

20. A method of assembling a package, the method comprising:

providing a primary package, the primary package comprising a first support for supporting one or more items and a second support for supporting one or more items, a primary structure for selectively blocking access to the one or more items in the first support and a second primary structure for selectively blocking access to the one or more items in the second support, wherein the first support is movable in an opening direction from a first position in which the primary structure blocks access to the one or more items to a second position in which the one or more items are accessibly clear of the primary structure, wherein the first support and primary structure comprise co-operating latch features configured to engage when the support and primary structure are arranged in the first position to prevent movement of the support in the opening direction, and configured to disengage on moving at least one latch feature in an unlatching direction to permit movement of the support in the opening direction, and wherein the second primary structure and the second support comprise second co-operating latch features configured to engage when the second support and second primary structure are arranged in the first position;

providing a secondary structure comprising a disengagement region and a second disengagement region; and arranging the primary package in the secondary structure, such that the disengagement region of the secondary structure at least partially aligns with the latch features of the primary package, and the second disengagement region at least partially aligns with the second latch features when the second support and the second primary structure are arranged in the first position, wherein the secondary structure is configured to permit disengagement of the second latch features of the second support and the second primary structure when the second disengagement region is at least partially aligned with the second latch features.

* * * * *